US009367009B2

(12) United States Patent
Akiyama et al.

(10) Patent No.: US 9,367,009 B2
(45) Date of Patent: Jun. 14, 2016

(54) FIXING MEMBER HAVING A POROUS ELASTIC LAYER WITH A NEEDLE-LIKE FILLER

(71) Applicant: CANON KABUSHIKI KAISHA, Tokyo (JP)

(72) Inventors: Naoki Akiyama, Toride (JP); Shigeaki Takada, Abido (JP); Daigo Matsuura, Tokyo (JP); Yasuhiro Miyahara, Tokyo (JP); Akeshi Asaka, Kashiwa (JP); Shuichi Tamura, Moriya (JP); Toshinori Nakayama, Kashiwa (JP); Yutaka Arai, Kawasaki (JP); Jun Miura, Kawasaki (JP); Takeshi Suzuki, Yokohama (JP); Katsuhisa Matsunaka, Inagi (JP); Shinsuke Takahashi, Kashiwa (JP); Hiroto Sugimoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/755,098

(22) Filed: Jun. 30, 2015

(65) Prior Publication Data

US 2016/0018766 A1 Jan. 21, 2016

(30) Foreign Application Priority Data

Jul. 16, 2014 (JP) ..... 2014-145828

(51) Int. Cl.
*G03G 15/20* (2006.01)

(52) U.S. Cl.
CPC ..... *G03G 15/206* (2013.01); *G03G 2215/2035* (2013.01)

(58) Field of Classification Search
CPC ..... G03G 15/206
USPC ..... 399/331, 333
See application file for complete search history.

(56) References Cited

U.S. PATENT DOCUMENTS 7,974,563 B2 * 7/2011 Sakai et al. ..... G03G 15/2053 399/333
8,688,023 B2 * 4/2014 Sekihara et al. ..... G03G 15/206 399/333

(Continued)

FOREIGN PATENT DOCUMENTS

JP 2001-265147 A 9/2001
JP 2002-351243 A 12/2002

OTHER PUBLICATIONS

Tamura et al., U.S. Appl. No. 14/755,075, filed Jun. 30, 2015.

(Continued)

*Primary Examiner* — William J Royer
(74) *Attorney, Agent, or Firm* — Fitzpatrick, Cella, Harper & Scinto

(57) ABSTRACT

A fixing member used for fixing a toner image on a recording material includes: a base layer; and a porous elastic layer provided on the base layer and containing a needle-like filler. The elastic layer has a thermal conductivity with respect to a longitudinal direction thereof in a first region where the elastic layer is contactable to the recording material on the fixing member, and the thermal conductivity is 6 times to 900 times a thermal conductivity with respect to a thickness direction in the first region. The elastic layer has a thermal conductivity with respect to the thickness direction thereof in a second region outside the first region with respect to the longitudinal direction, and the thermal conductivity with respect to the thickness direction in the second region is larger than the thermal conductivity with respect to the thickness direction in the first region.

17 Claims, 14 Drawing Sheets

(56) References Cited

U.S. PATENT DOCUMENTS

| | | | | |
|---|---|---|---|---|
| 8,755,726 | B2 | 6/2014 | Sugimoto | |
| 8,913,937 | B2 * | 12/2014 | Sakakibara | G03G 15/2057 399/331 |
| 9,063,491 | B2 | 6/2015 | Matsunaka et al. | |
| 2014/0255067 | A1 | 9/2014 | Matsunaka et al. | |
| 2014/0301763 | A1 | 10/2014 | Miura et al. | |
| 2015/0071690 | A1 | 3/2015 | Miyahara et al. | |
| 2015/0160596 | A1 | 6/2015 | Asaka et al. | |

OTHER PUBLICATIONS

Asaka et al., U.S. Appl. No. 14/741,750, filed Jun. 17, 2015.
Takada et al., U.S. Appl. No. 14/798,613, filed Jul. 14, 2015.
Miura et al., U.S. Appl. No. 14/730,766, filed Jun. 4, 2015.

* cited by examiner

| NON-SHEET-PASSING PORTION TEMPERATURE | COMP. EX. | EMB. 5 | EMB. 6 | EMB. 7 |
|---|---|---|---|---|
| 190 ℃ | ○ | ○ | ○ | ○ |
| 210 ℃ | ○ | ○ | ○ | ○ |
| 225 ℃ | × | ○ | ○ | ○ |
| 230 ℃ | × | ○ | ○ | ○ |

FIXING MEMBER HAVING A POROUS ELASTIC LAYER WITH A NEEDLE-LIKE FILLER

FIELD OF THE INVENTION AND RELATED ART

The present invention relates to a fixing member. This fixing member is usable in an image forming apparatus such as a copying machine, a printer, a facsimile machine and a multi-function machine having a plurality of functions of these machines.

A fixing device mounted in an image forming apparatus of an electrophotographic type includes a pair of fixing members. As this pair of fixing members, it is possible to cite a fixing roller and a pressing roller as an example.

In such a fixing device, in the case where a small-sized recording material is continuously subjected to fixing of a toner image thereon, there is a liability that a region where the fixing roller or the pressing roller does not contact the recording material (hereinafter referred to as a non-passing region) excessively increases in temperature.

Therefore, in a device disclosed in Japanese Laid-Open Patent Application 2002-351243, a needle-like filler is contained in an elastic layer of a pressing roller, so that high heat conduction with respect to an axial direction (longitudinal direction) is realized.

However, a degree of heat conduction in the axial direction of the pressing roller is large, and therefore such an elastic layer is advantageous in terms of "alleviation of instantaneous temperature rise", but the degree of heat conduction in a thickness direction is small, and therefore heat cannot be dissipated into a core metal of the pressing roller.

SUMMARY OF THE INVENTION

According to an aspect of the present invention, there is provided a fixing member used for fixing a toner image on a recording material, comprising: a base layer; and a porous elastic layer provided on the base layer and configured to contain a needle-like filler, wherein the elastic layer has a thermal conductivity with respect to a longitudinal direction thereof in a first region where the elastic layer is contactable to the recording material on the fixing member, the thermal conductivity is 6 times to 900 times a thermal conductivity with respect to a thickness direction in the first region, and wherein the elastic layer has a thermal conductivity with respect to the thickness direction thereof in a second region outside the first region of the fixing member with respect to the longitudinal direction, the thermal conductivity with respect to the thickness direction in the second region is larger than the thermal conductivity with respect to the thickness direction in the first region.

According to another aspect of the present invention, there is provided a fixing member used for fixing a toner image on a recording material, comprising: a base layer; and a porous elastic layer provided on the base layer and configured to contain a needle-like filler, wherein the elastic layer has a thickness in a first region where the elastic layer is contactable to the recording material on the fixing member, and has a thickness in a second region outside the first region of the fixing member with respect to a longitudinal direction, the thickness in the second region is larger than the thickness in the first region.

These and other objects, features and advantages of the present invention will become more apparent upon a consideration of the following description of the preferred embodiments of the present invention taken in conjunction with the accompanying drawings.

DESCRIPTION OF EMBODIMENTS

Embodiments of the present invention will be described with reference to the drawings.

(1) Image Forming Portion

Figure 6:
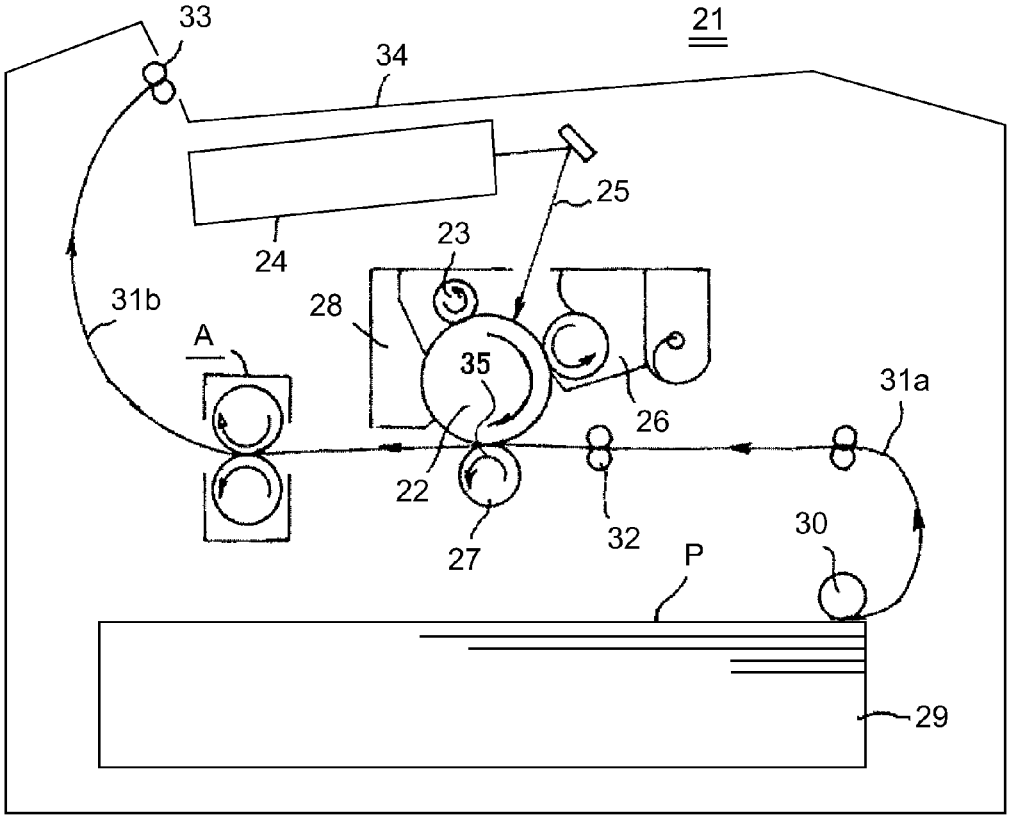
FIG. 6 is a schematic structural view of an example of an image forming apparatus.

FIG. 6 is a schematic sectional view showing a structure of an example of an image forming apparatus 21 in which an image heating apparatus in accordance with the present invention as a fixing device A.

This image forming apparatus 21 is a laser printer of an electrophotographic type and includes a photosensitive drum 22 as an image bearing member for bearing a latent image. The photosensitive drum 22 is rotationally driven in the clockwise direction of an arrow at a predetermined speed, and another surface thereof is electrically charged uniformly to a predetermined polarity and a predetermined potential by a charging device 23. The uniformly charged surface of the photosensitive drum 22 is subjected to laser scanning exposure to light 25 of image information by a laser scanner (optical device) 24. As a result, on the surface of the photosensitive drum 22, an electrostatic latent image of the image information obtained by the scanning exposure is formed.

The electrostatic latent image is developed into a toner image by a developing device 26. The toner image is successively transferred onto a sheet-like recording material (hereinafter referred to as a sheet or paper) P at a transfer portion 35, into which the sheet P is introduced, which is a contact portion between the photosensitive drum 22 and a transfer roller 27.

The sheets P are staked and accommodated in a sheet feeding cassette 29 provided at a lower portion of an inside of a main assembly of the image forming apparatus 21. When a sheet feeding roller 30 is driven at predetermined timing, one of the sheets P in the sheet feeding cassette 29 is separated and fed, and passes through a feeding path 31*a* to reach a registration roller pair 32. The registration roller pair 32 receives a leading end portion of the sheet P and corrects oblique movement thereof. Further, the sheet P is fed to the transfer portion 35 in synchronism with the toner image on the photosensitive drum 22 so as to provide timing when the leading end portion of the sheet P just reaches the transfer portion 35 when a leading end portion of the toner image on the photosensitive drum 22 reaches the transfer portion 35.

The sheet P passed through the transfer portion 35 is separated from the surface of the photosensitive drum 22 and then is fed to the fixing device A. By this fixing device A, an unfixed toner image on the sheet P is fixed as a fixed image on the sheet surface by heating and pressure application. Then, the sheet P passes through the feeding path 31*b* and then is discharged and stacked by a discharging roller pair 33 on a discharge tray 34 at an upper surface of the image forming apparatus main assembly. The surface of the photosensitive drum 22 after the separation of the sheet is cleaned by removing a residual deposited matter such as a transfer residual toner therefrom by a cleaning device 28, and then is repetitively subjected to image formation.

(2) Fixing Device A

Figure 1:
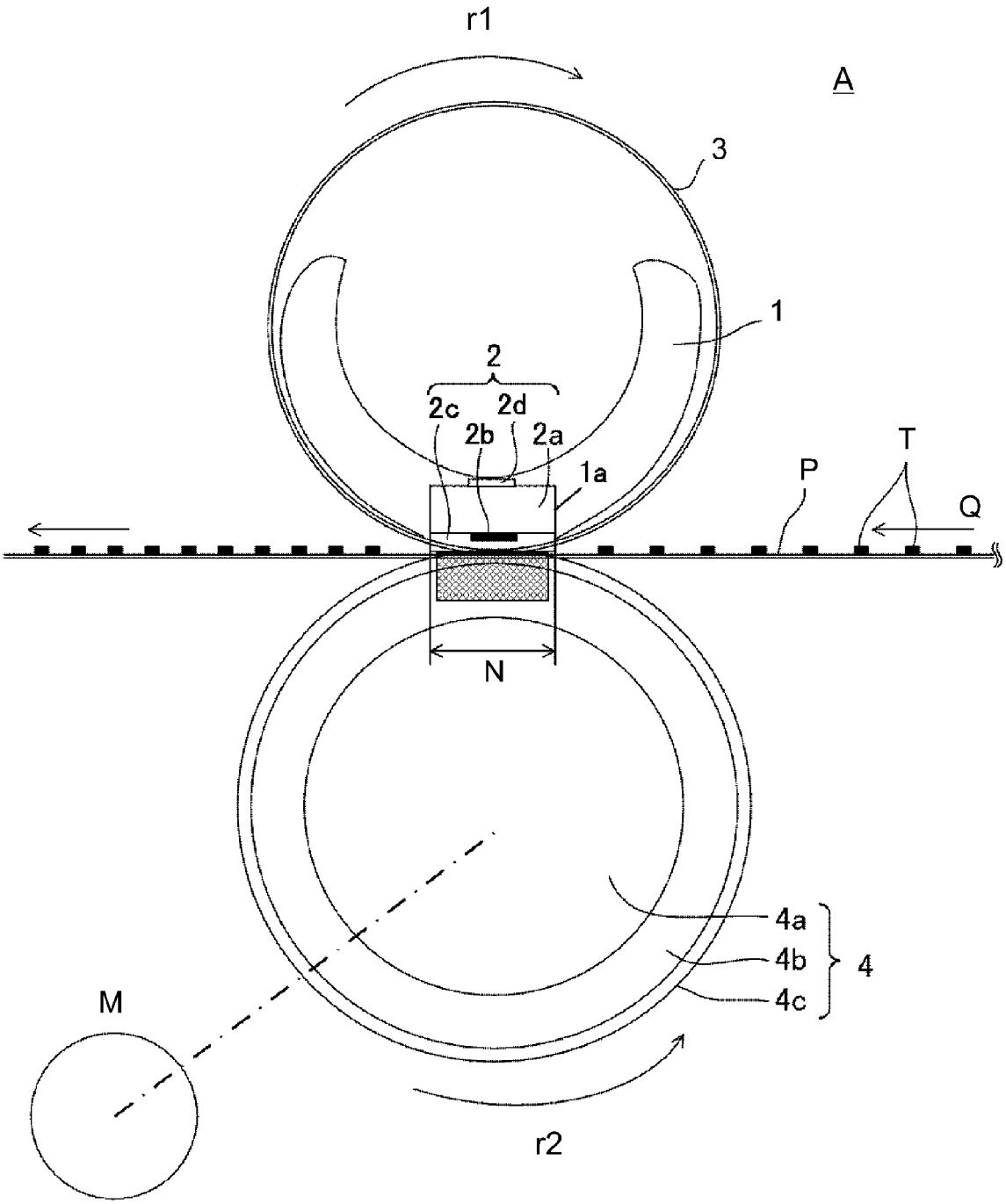
FIG. 1 is a schematic cross-sectional view showing a structure of a fixing device in an embodiment.

FIG. 1 is a schematic sectional view of the fixing device A. This fixing device A is a device of a film (belt) heating type, and a schematic structure thereof will be described below. In the following description, with respect to the fixing device A and members constituting the fixing device A, an axial direction is a direction perpendicular to a sheet feeding direction in a plane of the sheet. A length is a dimension with respect to the axial direction.

An elongated film guide member 1 has a trough shape having a substantially semi-circular cross-section and extends in a longitudinal direction which is a direction perpendicular to the drawing sheet (of FIG. 1). For example, the film guide member 1 is constituted by a heat-resistant resin material such as PPS (polyphenylenesulfide) or a liquid crystal polymer. An elongated plate-like heater 2, as a heating member, accommodated and held in a groove 1*a* formed along the longitudinal direction at a substantially central portion of a lower surface of the film guide member 1. An endless (cylindrical) fixing film (fixing belt) 3 as a fixing member (member for fixing) is loosely fitted around the film guide member 1 in which the heater 2 is mounted.

The heater 2 has a constitution in which a heat generating resistor is provided on a ceramic substrate. The heater 2 shown in FIG. 1 includes an elongated thin plate-like heater substrate 2*a* of alumina or the like and a thin strip-like energization heat generating member (heat generating resistor) 2*b* formed of Ag/Pd or the like along the longitudinal direction in the front surface side (film sliding surface side). Further, the heater 2 includes a thin surface protective layer 2*c* such as a gloss layer for covering and protecting the energization heat generating member 2*b*. Further, in the back surface side of the heater substrate 2*a*, a temperature detecting element 2*d* such as a thermistor contacts the heater substrate 2*a*.

The heater 2 quickly increases in temperature by supplying electric power to the energization heat generating member 2*b*, and thereafter is controlled by an electric power control system including the temperature detecting element 2*d* so as to maintain a predetermined fixing temperature (target temperature).

The fixing film 3 is a composite layer film formed by coating a surface layer on a surface of a base film in a total film thickness of 100 μm or less, preferably 20 μm or more and 60 μm or less in order to improve a quick start property of the fixing device A.

As a material for the base film, a resin material such as PI (polyimide), PAI (polyamideimide), PEEK (polyether ether ketone) or PES (polyethersulfone) or a metal material such as SUS or Ni is used. As a material for the surface layer, a fluorine-containing resin material such as PTFE (polytetrafluoroethylene), PFA (tetrafluoroethylene-perfluoroalkylvinylether) or FEP (fluorinated ethylene propylene resin is used.

A pressing roller 4 as the fixing member has elasticity and forms a nip (fixing nip) N, where the sheet P carrying thereon a toner image T is nipped and fed, by being elastically deformed by press-contact with the fixing film 3 as a heating member. In the fixing device A shown in FIG. 1, the heater 2 and the pressing roller 4 press-contact the fixing film 3 in parallel to each other with respect to the longitudinal at a predetermined pressure. As a result, between the fixing film 3 and the pressing roller 4, with respect to a sheet feeding direction (recording material feeding direction) Q, the nip N having a predetermined width necessary to heat-fix the toner image T is formed.

The press-contact between the fixing film 3 and the pressing roller 4 may have a constitution in which the pressing roller 4 is press-contacted to the fixing film 3 by a pressing mechanism (unshown) or a constitution in which the fixing film 3 is press-contacted to the pressing roller 4. Further, it is also possible to employ a constitution in which both of the fixing film 3 and the pressing roller 4 are press-contacted to each other at a predetermined pressure.

In the fixing device A shown in FIG. 1, a driving force of a driving source (motor) M is transmitted to the pressing roller 4 via a power transmitting mechanism such as an unshown gear, so that the pressing roller 4 is rotationally driven in the counterclockwise direction of an arrow r2 at a predetermined peripheral speed. When the pressing roller 4 is rotationally driven, the fixing film 3 is rotated by rotation of the pressing roller 4 in the clockwise direction of an arrow r1 around the film guide member 1 while sliding on the surface of the surface protective layer 2*c* of the heater 2 in close contact with the surface of the surface protective layer 2*c* in the nip N at an inner surface thereof.

The sheet P carrying thereon the unfixed toner image T is introduced into the nip N in a state in which the pressing roller 4 is rotationally driven and the fixing film 3 is rotated by rotation of the pressing roller 4, and the heater 2 is increased in temperature by energization and is temperature-controlled at a predetermined temperature. The fixing film 3 faces the toner image carrying surface side (sheet front surface side) of the sheet P, and the pressing roller 4 faces an opposite surface side (sheet back surface side) of the sheet P. The sheet P is nipped and fed at the nip N and is supplied with heat from the heated fixing film 3 during passing thereof through the nip N, so that the sheet P is subjected to pressure application at the nip N. By this heating and pressure application, the unfixed toner image is fixed as a fixed image on the surface of the sheet P.

(3) Pressing Roller 4

Figure 2:
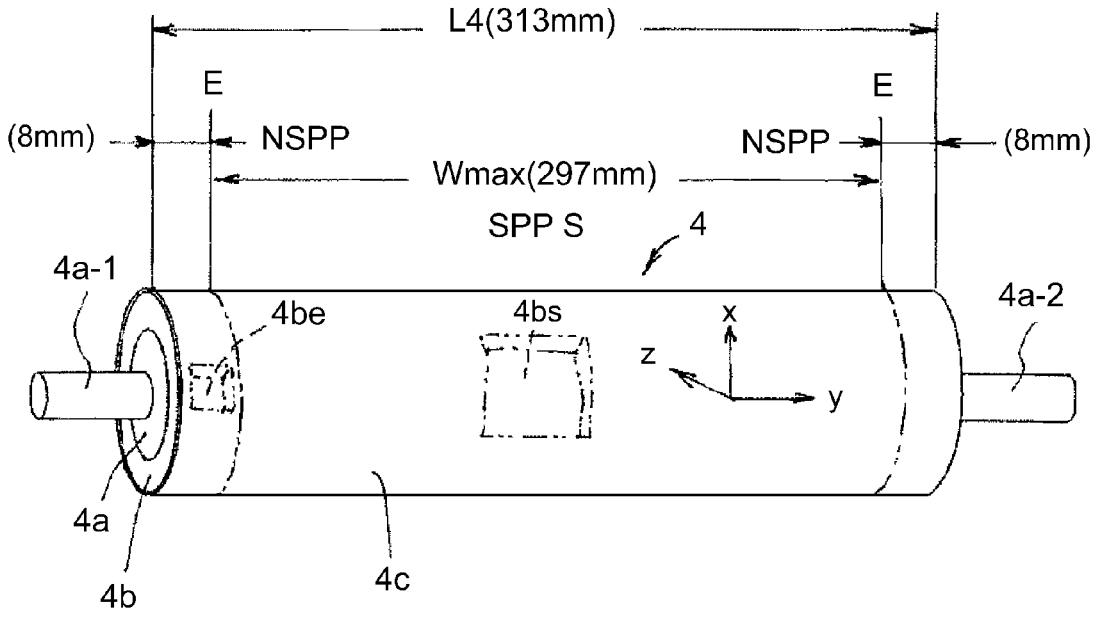
FIG. 2 is a perspective view of a pressing roller.

FIG. 2 is a schematic bird's-eye view (schematic perspective view of an outer appearance) of the pressing roller 4 shown in FIG. 1. The pressing roller 4 shown in FIGS. 1 and 2 includes a base material (base layer, core metal) 4*a* of iron, aluminum or the like, and an elastic layer 4*b* consisting of a silicone rubber and a parting layer 4*c* consisting of a fluorine-containing resin tube which are obtained by materials and manufacturing methods described specifically later.

An outer diameter of the base material 4*a* is, e.g., 4 mm-80 mm. Small-diameter shaft portions 4*a*-1 and 4*a*-2 are provided in one end-side and the other end-side, respectively, of the base material 4*a* with respect to a longitudinal position so as to be concentric with the base material 4*a*. Each of the small-diameter shaft portions 4*a*-1 and 4*a*-2 is a portion rotatably shaft-supported by an unshown fixing portion such as a frame of the fixing device A.

Here, as shown in FIG. 2, in the following, a circumferential direction (sheet feeding direction) is represented by "x" direction, a longitudinal direction (axial direction) of the pressing roller 4 is represented by "y" direction, and a thickness direction (layer thickness direction) of constituent layers of the pressing roller 4 is represented by "z" direction. L4 represents a length (width) dimension of the pressing roller 4. In this embodiment, the length L4 of the pressing roller 4 is set at 313 mm.

Wmax is a width of a maximum width-sized sheet capable of being introduced into the nip N (fixing device A). In this embodiment, the width Wmax of the maximum width-sized sheet is a width (297 mm) of a A4-sized sheet fed in a long edge feeding manner on a so-called center(-line) basis. With respect to the longitudinal direction of the pressing roller 4, a portion (region) corresponding to the width Wmax is referred to as a sheet-passing portion region (passing portion region, hereinafter referred to as a sheet-passing portion) S. Further, a roller portion (region) outside the sheet-passing portion S is referred to as a non-sheet-passing portion region (non-passing portion, hereinafter referred to as a non-sheet-passing portion) E. In this embodiment, with respect to the longitudinal direction y of the pressing roller 4, a width portion of 297 mm corresponding to the width Wmax described above is the sheet-passing portion S, a portion of 8 mm outside the sheet-passing portion S at each of end portions is the non-sheet-passing portion E.

Further, the elastic layer 4*b* has the following features. That is, the elastic layer 4*b* is, as shown in schematic views of (a) and (b) of FIG. 3, a porous elastic layer (foam material layer) containing a needle-like filler 4*b*1 and a pore portion 4*b*2. Further, a thermal conductivity λ3 of an elastic layer 4*be* ((a) of FIG. 3) at the non-sheet-passing portion E with respect to the thickness direction z is higher than a thermal conductivity λ2 of the elastic layer 4*be* at the sheet-passing portion S with respect to the thickness direction z. Further, a thermal conductivity λ1 of an elastic layer 4*bs* ((b) of FIG. 3) at the sheet-passing portion S with respect to a planar direction (axial direction y and circumferential direction x) is 6 times or more and 900 times or less the thermal conductivity λ2 with respect to the thickness direction z.

That is, in this embodiment, as the elastic layer 4*b*, a silicone rubber having sponge-like pore portions 4*b*2 was used since such an elastic layer is advantageous in terms of a lowering in thermal capacity and thermal conductivity. Further, the elastic layer 4*b* includes the needle-like filler (heat-conductive filler) 4*b*1 oriented in the axial direction and the circumferential direction of the base material 4*a* in order to provide heat-conduction anisotropy. A thickness of the elastic layer 4*b* is not particularly restricted if the nip N having a predetermined width with respect to a sheet feeding direction Q can be formed between the fixing film 3 and the pressing roller 4, but may preferably be 2 mm-10 mm.

A thickness of the parting layer 4*c* can be arbitrarily set so long as a sufficient parting property can be imparted to the pressing roller 4 and other required performances of the pressing roller 4 are maintained. In general, the thickness of the parting layer 4*c* is 20 μm-50 μm.

By the pressing roller 4 having the above-described constitution, it is possible to obtain a rise time shortening effect of the fixing device A while suppressing non-sheet-passing portion temperature rise (non-passing portion temperature rise) during continuous passing of a small-sized sheet smaller in width than a large-sized sheet having the maximum width (size) usable in the fixing device A. In the following, materials constituting such a pressing roller 4 and a manufacturing method of the pressing roller 4 and the like will be described in detail.

(4) Manufacturing Method of Pressing Roller 4

(4-1) Liquid Composition Compounding Step

The needle-like filler 4*b*1 and a water-containing material obtained by incorporating water in a water-absorptive polymer are compounded with an uncrosslinked addition-curing type silicone rubber. The compounding can be made by weighing a predetermined of each of the uncrosslinked addition-curing type silicone rubber, the needle-like filler 4*b*1 and the water-containing material and then by dispersing the needle-like filler 4*b*1 by a known filler mixing and stirring means such as a planetary universal mixing and stirring device.

Figure 7:
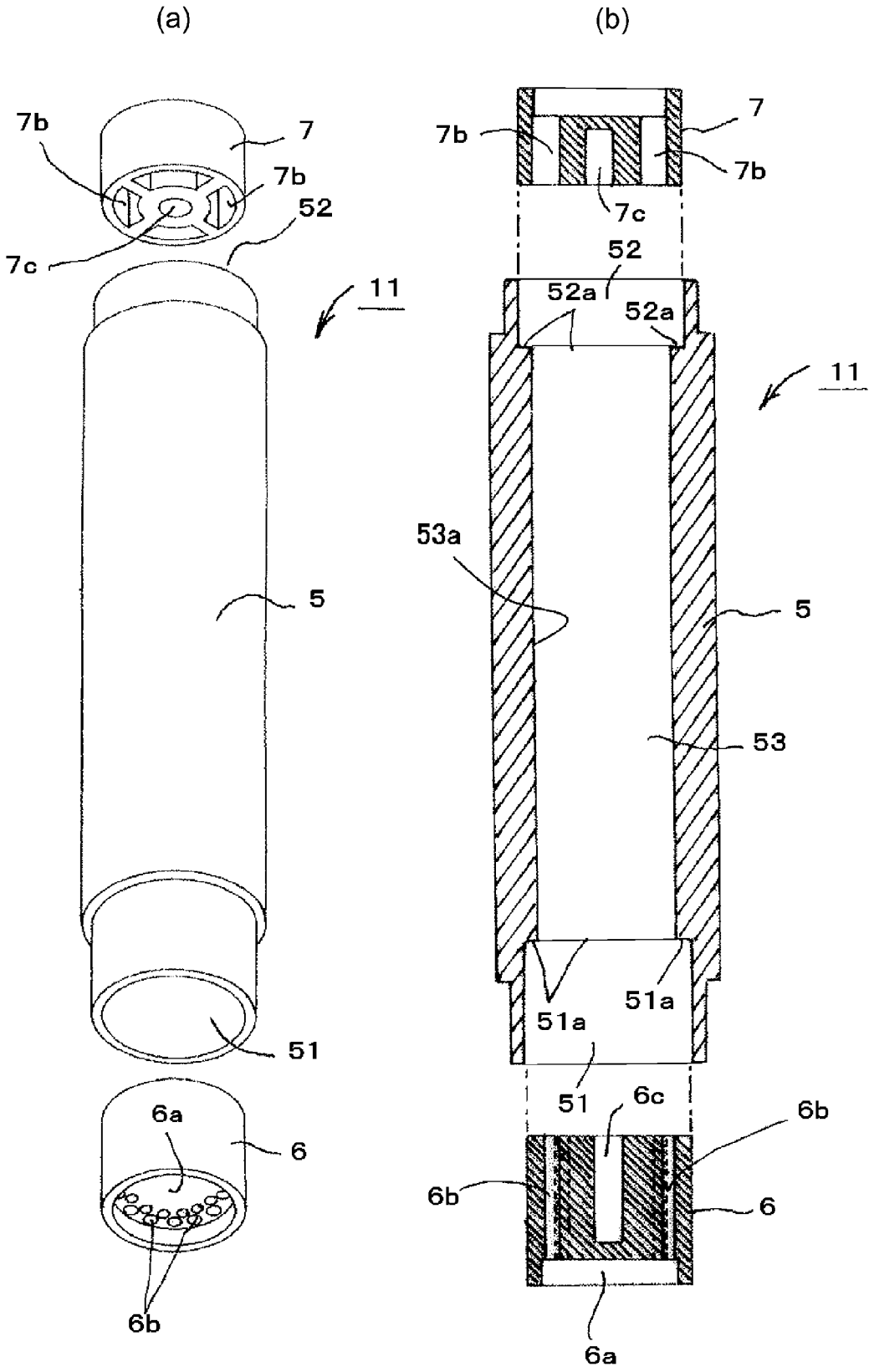
In FIG. 7, (a) and (b) are illustrations of a structure of a metal mold.

(4-2) Molding of Elastic Layer 4*b* Using a Liquid Composition (4-2-1) Metal Mold In FIG. 7, (a) is an exploded perspective view of a metal mold 11 used in casting manufacturing of the pressing roller 4 in this embodiment, and (b) is a longitudinal sectional view of a hollow metal mold 5, a one end-side piece mold (inserting mold) 6 and the other end-side piece mold (inserting mold) 7, which constitute the metal mold 11. The metal mold 11 includes the hollow metal mold (hollow cylindrical metal mold, pipe-like cylindrical mold) 5 having a cylindrical molding space (hereinafter referred to as a cavity) 53, and the one end-side piece mold 6 and the other end-side piece mold 7 mounted into a one end-side opening 51 and the other end-side opening 52, respectively, of the hollow metal mold 5.

The one end-side piece mold 6 is a piece mold for permitting injection of the liquid rubber into the cavity 53 of the hollow metal mold 5. The other end-side piece mold 7 is a piece mold for permitting discharge of air pushed out from the inside of the cavity 53 with the injection of the liquid rubber into the cavity 53.

Figure 8:
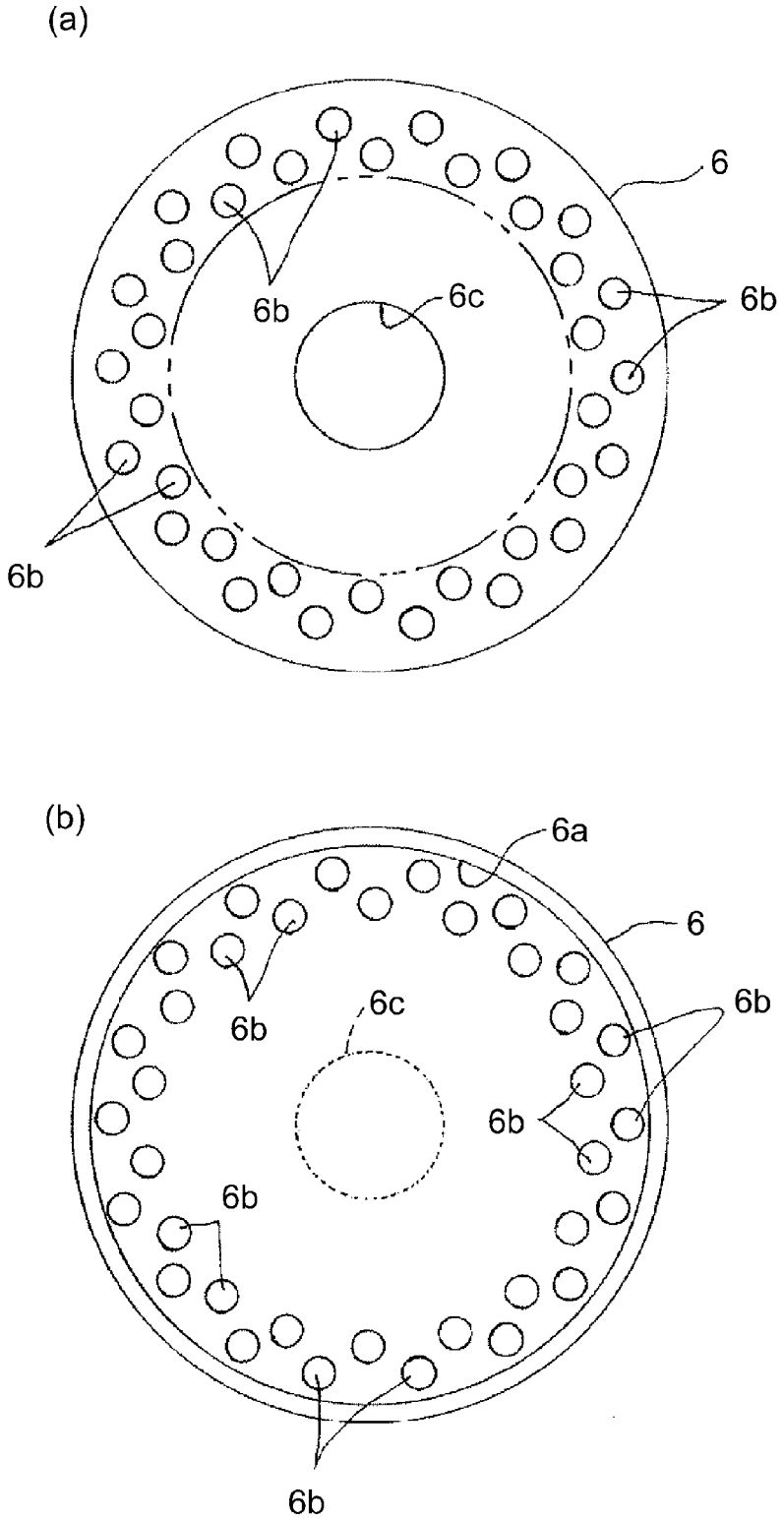
In FIG. 8, (a) and (b) show a shape of injection holes provided in one end-side piece mold (inserting mold).

In FIG. 8, (a) is an inner surface view (cavity-side end surface view) of the one end-side piece mold 6, and (b) is an outer surface view (end surface view in a side opposite from the cavity side) of the one end-side piece mold 6. At a central portion of the one end-side piece mold 6 in an inner surface side, a central hole 6*c* as a base material holding portion into which the one end-side small-diameter shaft portion 4*a*-1 of the base material 4*a* is to be inserted is provided. Further, in the outer surface side, a circumferential hole (hollow, recessed portion) 6*a* is provided. Further, the circumferential hole 6*a* is provided with a plurality of liquid composition injection holes 6*b* which are disposed from the outer surface side to the inner surface side along a circumference of the circumferential hole 6*a*.

Further, at an inner surface central portion (cavity-side end surface central portion) of the other end-side piece mold 7, a central hole 7*c* as a base material holding portion into which the other end-side small-diameter shaft portion 4*a*-2 of the base material 4*a* is to be inserted is provided. Then, a plurality of discharging holes 7*b* are provided from the inner surface side to the outer surface side.

The one end-side piece mold 6 is engaged into the one end-side opening 51 from the inner surface side and is inserted sufficiently until a circumferential edge portion in the inner surface side is abutted against and received by a circular stepped portion 51*a* on an inner peripheral surface of the opening, so that the one end-side piece mold 6 is mounted in the one end-side of the hollow metal mold 5. Further, the other end-side piece mold 7 is engaged into the other end-side opening 52 from the inner surface side and is inserted sufficiently until a circumferential edge portion in the inner surface side is abutted against and received by a circular stepped portion 52*a* on an inner peripheral surface of the opening, so that the one end-side piece mold 6 is mounted in the other end-side of the hollow metal mold 5.

(4-2-2) Placement of Base Material in Metal Mold

The base material 4*a* was subjected to known primer treatment in advance at a portion where the rubber elastic layer 4*b* is to be formed. In the case where the elastic layer 4*b* and the base material 4*a* are interlayer-bonded to each other, the primer may also be not used.

Figure 9:
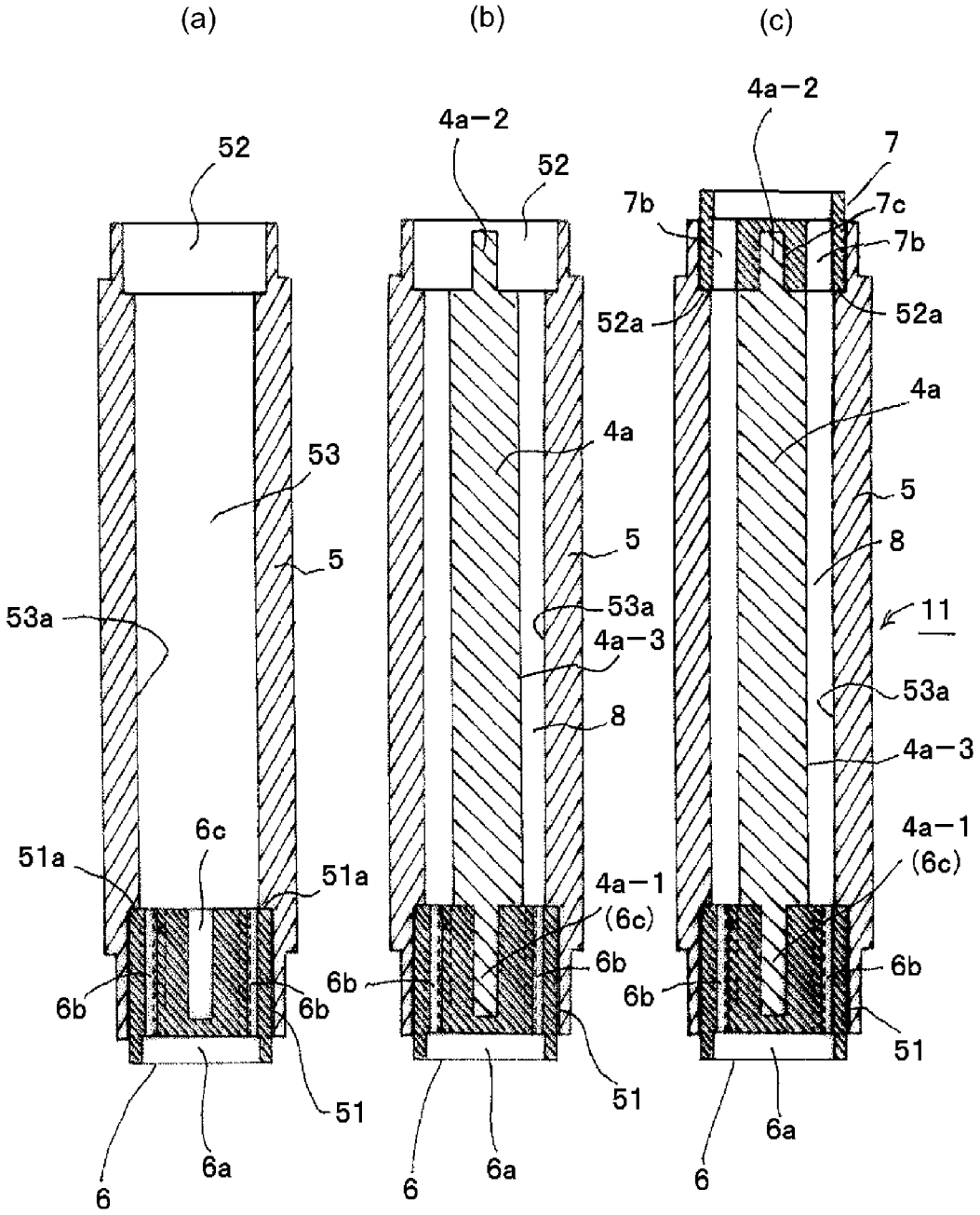
In FIG. 9, (a)-(c) are illustrations of a manner of mounting a roller base material in the metal mold.

As shown in (a) of FIG. 9, the one end-side piece mold 6 is mounted into the one end-side opening 51 of the hollow metal mold 5. Then, as shown in (b) of FIG. 9, the above-described base material 4*a* is inserted into the hollow metal mold 5 through the other end side opening 52 from the one end-side small-diameter shaft portion 4*a*-1 side, and then the small-diameter shaft portion 4*a*-1 is inserted into and supported by the inner surface-side central hole 6*c* of the one end-side piece mold 6.

Then, as shown in (c) of FIG. 9, the other end-side piece mold 7 is mounted into the hollow metal mold 5 through the other end side opening 52 in a state in which the other end-side small-diameter shaft portion 4*a*-2 of the base material 4*a* is inserted into and supported by the inner surface-side central hole 7*c*.

As a result, the base material 4*a* is concentrically positioned and held at the cylindrical central portion of the cylindrical cavity 53 of the metal mold 5 in a state in which the one end-side and the other end-side small-diameter shaft portions 4*a*-1 and 4*a*-2 are supported by the central holes 6*c* and 7*c* of the one end-side and the other end-side piece molds 6 and 7, respectively. Further, between a cylinder molding surface (inner peripheral surface) 53*a* of the cylindrical cavity 53 and an outer surface (outer peripheral surface) 4*a*-3 of the base material 4*a*, a gap (spacing) 8 for permitting cast molding of the rubber elastic layer 4*b* having a predetermined thickness is formed around the outer periphery of the base material 4*a*.

Incidentally, the placement of the base material 4*a* in the cavity 53 of the metal mold 11 is not limited to the above-described procedure. The hollow metal mold 5, the base material 4*a*, the one end-side piece mold 6 and the other end-side piece mold 7 may only be finally assembled as shown in (c) of FIG. 9.

(4-2-3) Liquid Composition Layer Molding Step

Figure 10:
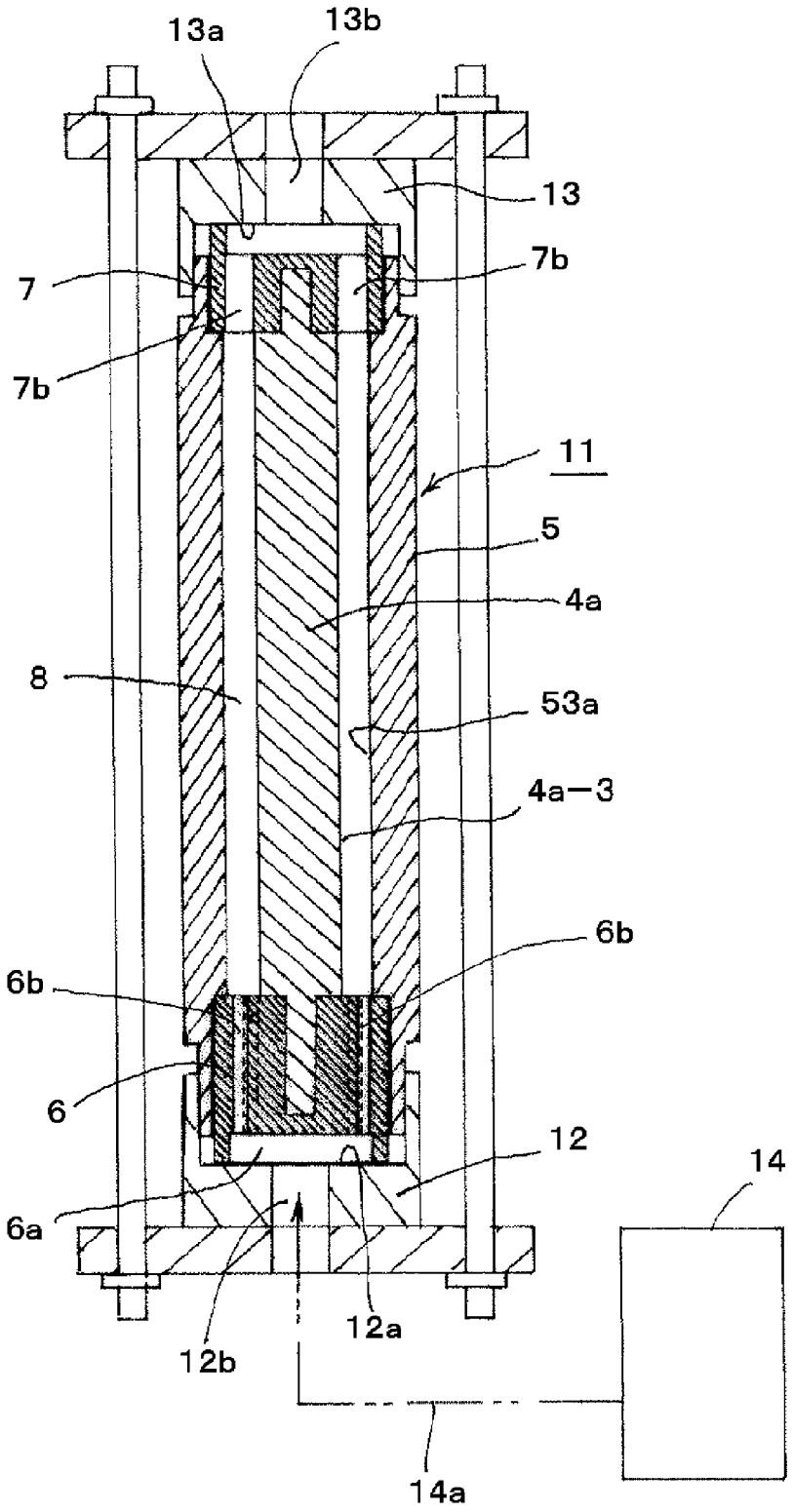
FIG. 10 is an illustration of an injection step.

The metal mold 11 in which the base material 4*a* is provided in the cavity 53 as described above is, as shown in FIG. 10, pressed and fixedly held in a vertical attitude between a lower-side jig 12 and an upper-side jig 13 which oppose each other while the one end-side piece mold 6 side is a lower side and the other end-side piece mold 7 side is an upper side. The one end-side piece mold (hereinafter referred to as a lower piece mold) 6 of the metal mold 11 is engaged into and received by a receiving hole 12*a* of the lower-side jig 12. The other end-side piece mold (hereinafter referred to as an upper piece mold) 7 of the metal mold 11 is engaged into and received by a receiving hole 13*a* of the upper-side jig 13.

That is, the metal mold 11 is fixedly held between the lower-side jig 12 and the upper-side jig 13 in a vertical attitude state in which a cylindrical axial line of the cylindrical cavity 53 is vertically directed and a side where the injection holes 6*b* are disposed is the lower side, and then a casting step is performed. At a central portion of the receiving hole 12*a* of the lower-side jig 12, a liquid composition injection port 12*b* is provided. To the liquid composition injection port 12*b*, a liquid composition supplying pipe 14*a* of an external liquid composition supplying device 14 is connected. At a central portion of the receiving hole 13*a* of the upper-side jig 13, a discharging port 13*b* is disposed.

The supplying device 14 is driven, and the liquid composition of (4-1) described above passes through the supplying pipe 14*a* and enters the receiving hole 12*a* through the injection port 12*b*, so that the liquid composition is filled in a space portion constituted by the receiving hole 12*a* and the circumferential hole 6*a* in the outer surface side of the lower piece mold 6. With subsequent supply of the liquid composition, the filled liquid composition passes through the plurality of injection holes 6*b* provided along the circumference of the circumferential hole 6*a* and flows from the outer surface side toward the inner surface side of the lower piece mold 6. Then, the liquid composition is injected into the gap 8 formed between the cylinder molding surface 53*a* of the cavity 53 and the outer surface 4*a*-3 of the base material 4*a*.

With further subsequent supply of the liquid composition, the injection of the liquid composition into the gap 8 has advanced from below to above. Air existing in the gap 8 is pushed up from below in the gap 8 with the injection of the liquid composition into the gap 8 from below toward above, so that the liquid composition passes from the gap 8 through a discharging hole 7*b* of the upper piece mold 7 and the discharging port 13*b* of the upper-side jig 13, and comes out of the metal mold 11.

The injection of the liquid composition into the gap 8 through the respective injection holes 6*b* of the lower-side piece mold 6 is averagely made with respect to a circumferential direction of the gap 8. In addition, the base material 4*a* is in a state in which the base material 4*a* is concentrically fixed at the cylindrical central portion of the cavity 53 by the upper and lower piece molds 7 and 6, and is not moved by the injection of the liquid composition, so that the gap 8 can be filled with the liquid composition adequately without generating thickness deviation (non-uniformity).

In the above-described manner, the liquid composition is casted in the metal mold 11 in which the base material 4*a* is disposed while providing flowability in the axial direction and the circumferential direction. By this flow of the liquid composition during the injection, most of the needle-like filler 4*b*1 contained in the liquid composition is oriented in the axial direction of the base material 4*a*, i.e., the longitudinal direction (y direction) of the pressing roller 4 along the flow of the liquid composition.

Figure 3:
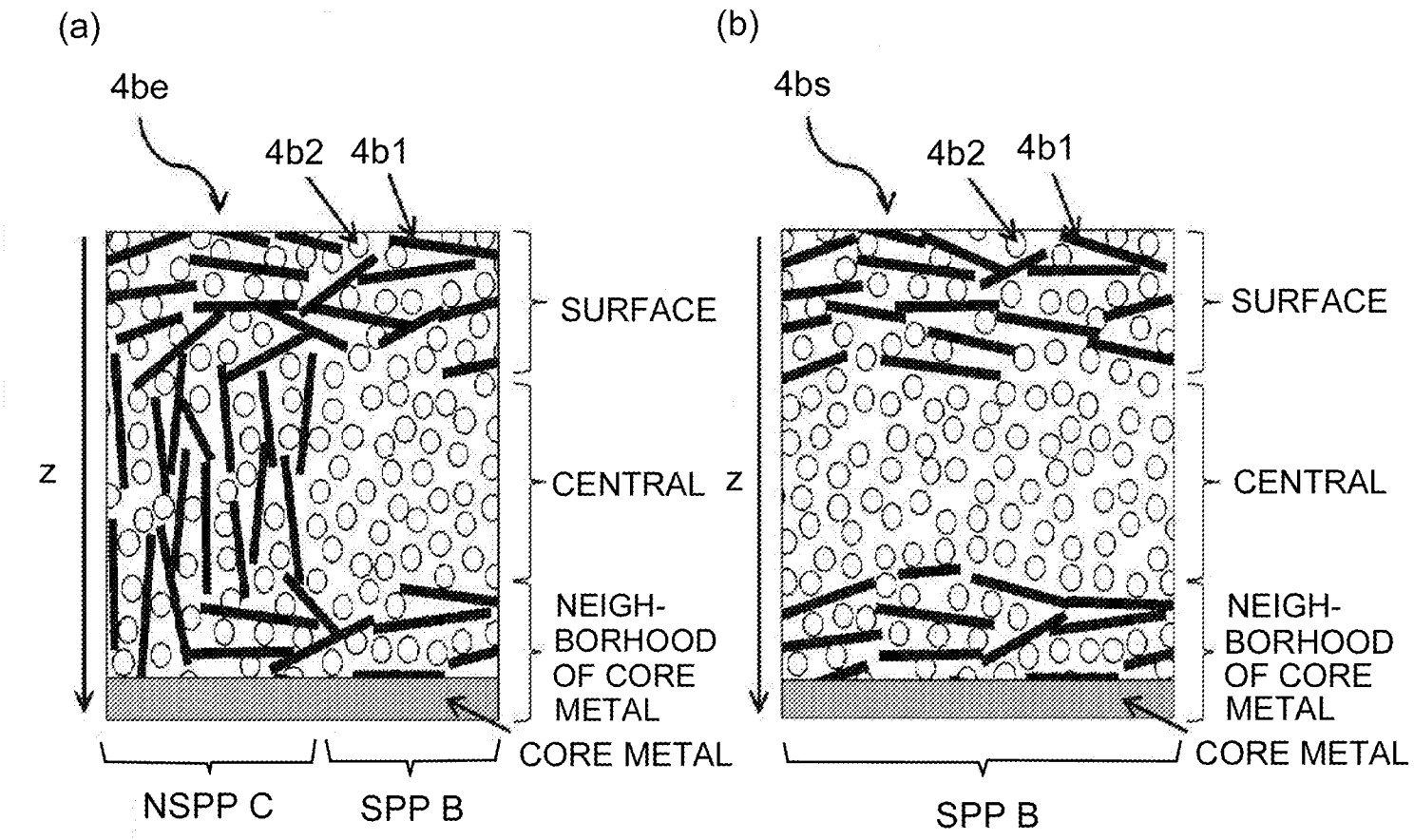
In FIG. 3, (a) is an enlarged sectional view of a sample 4*be* but from the pressing roller of FIG. 2, and (b) is an enlarged sectional view of a sample 4*bs* cut from the pressing roller of FIG. 2.

In FIG. 3, (b) is a schematic enlarged view of the elastic layer (sample) 4*bs* and the base material 4*a* as the core metal cut in the neighborhood of a longitudinal central portion of the elastic layer 4*b* of the pressing roller 4 shown in FIG. 2. By the flow of the liquid composition during the injection, the needle-like filler 4*b*1 is oriented with an average angle of 80 degrees or more and 100 degrees or less with respect to a normal direction to the surface of the pressing roller 4 shown in (b) of FIG. 3 in the (front) surface side. As a result, the thermal conductivity of the pressing roller 4 with respect to the axial direction y and the circumferential direction x (hereinafter a combination of the axial direction y and the circumferential direction x is referred to as a planar direction xy) is effectively enhanced.

Further, the end portions of the pressing roller 4 are an entrance side (lower piece mold 6 side) of the liquid composition during the injection and an opposite side (upper piece mold 7 side), where the liquid composition contacts an associated one of edges of the mold, and are portions corresponding to the edges of the mold for the casting. At these portions, the liquid composition flows in a complicated manner. For that reason, the needle-like filler 4*b*1 is not oriented in the planar direction xy but is oriented randomly. In FIG. 3, (a) is a schematic enlarged view of the elastic layer (sample) 4*be* and the base material 4*a* as the core metal cut in the neighborhood of a longitudinal end portion of the elastic layer 4*b* of the pressing roller 4 shown in FIG. 2. The needle-like filler 4*b*1 is oriented randomly. As a result, the thermal conductivity, with respect to the thickness direction z, of a portion corresponding to the end portion of the pressing roller 4 is higher than the thermal conductivity with respect to the thickness direction z, in the neighborhood of the longitudinal central portion of the pressing roller 4.

The injection of the liquid composition into the metal mold 11 is performed at least until the gap 8 is sufficiently filled with the liquid composition. There is no requirement to fill sufficiently the discharging hole 7*b* of the upper piece mold 7 with the liquid composition.

(4-2-4) Silicone Rubber Component Cross-Linking Curing Step

After the injection of the liquid composition (after the end of the injecting step), the metal mold 11 is demounted from the upper-side and lower-side jigs 13 and 12. At this time, outer openings of the lower piece mold 6 and the upper piece mold 7 are hermetically sealed by mounting of a blind plate so that the injected liquid rubber does not flow through the outer openings of the lower piece mold 6 and the upper piece mold 7. Then, in the hermetically sealed state of the metal mold 11, heat treatment is made at a temperature of not more than a boiling point of water for 5 minutes to 120 minutes. As a heat treatment temperature, 60° C. to 90° C. is desirable, so that the silicone rubber component is cross-linked and cured. The metal mold 11 is in the hermetically sealed state, and therefore the silicone rubber component can be cross-linked and cured while maintaining water content of the water-containing material.

(4-2-5) Demolding Step

The metal mold 11 is appropriate cooled with water or air, and thereafter the base material 4*a* on which the liquid composition layer after the cross-linking curing is laminated is removed from the metal mold 11.

Demolding is made by demounting the lower piece mold 7 and the upper piece mold 8 from the one end-side opening 51 and the other end-side opening 52, respectively. This demounting is made against bond strength of association portion (connecting portion) between an end surface of the liquid composition layer after the cross-linking curing in the hollow metal mold 5 and the liquid composition layer after the cross-linking curing in the holes 6*b* and 7*b* in the lower piece mold 6 and the upper piece mold 7, respectively. Then, the base material 4*a* on which the liquid composition layer after the cross-linking curing is laminated is pulled out from the inside of the hollow metal mold 11.

The resultant elastic roller is subjected to reforming for removing burrs and irregularity portion remaining on the one end-side and the other end-side of the liquid composition layer after the cross-linking curing, as desired.

(4-2-6) Dewatering Step

The liquid composition layer, after the cross-linking curing, which is laminated on the base material 4*a* is dewatered, so that the pore portion 4*b*2 is formed (step in which the water in the water-containing material is vaporized from the rubber cross-linked layer to form a porous elastic layer). As a heat-treatment condition, 100° C. to 250° C. and 1 hour to 5 hours are desirable. By this dewatering step, the liquid composition layer, after the cross-linking curing, which is laminated on the base material 4*a* becomes a porous elastic layer 4*b* including the needle-like filler 4*b*1 and the pore portion 4*b*2 by vaporization of the water. By forming the pore portion 4*b*2 in the elastic layer 4*b*, an effect of decreasing the thermal conductivity of the pressing roller 4 with respect to the thickness direction z is obtained. Further, also the thermal capacity can be made small. On the other hand, as for the thermal conductivity with respect to each of the longitudinal direction x and the circumferential direction y, the needle-like filler 4*b*1 constitutes a heat conduction path, so that the thermal conductivity can be maintained at a high level compared with the thermal conductivity with respect to the thickness direction z.

As described above, it becomes possible to form the elastic layer 4*b* having a high thermal conductivity with respect to the longitudinal direction y and the circumferential direction x and having a thermal conductivity, with respect to the thickness direction z, lower than the thermal conductivity with respect to the longitudinal direction y, and the circumferential direction x.

(4-2-7) Lamination Step of Parting Layer 4*c*

Using an adhesive, the fluorine-containing resin-made tube which is the parting layer (fluorine-containing resin layer) 4*c* is coated on the elastic layer 4*b* and is unified. In the case where the elastic layer 4*b* and the parting layer 4*c* are inter-layer-bonded to each other without using the adhesive, the adhesive may also be not used.

Figure 11:
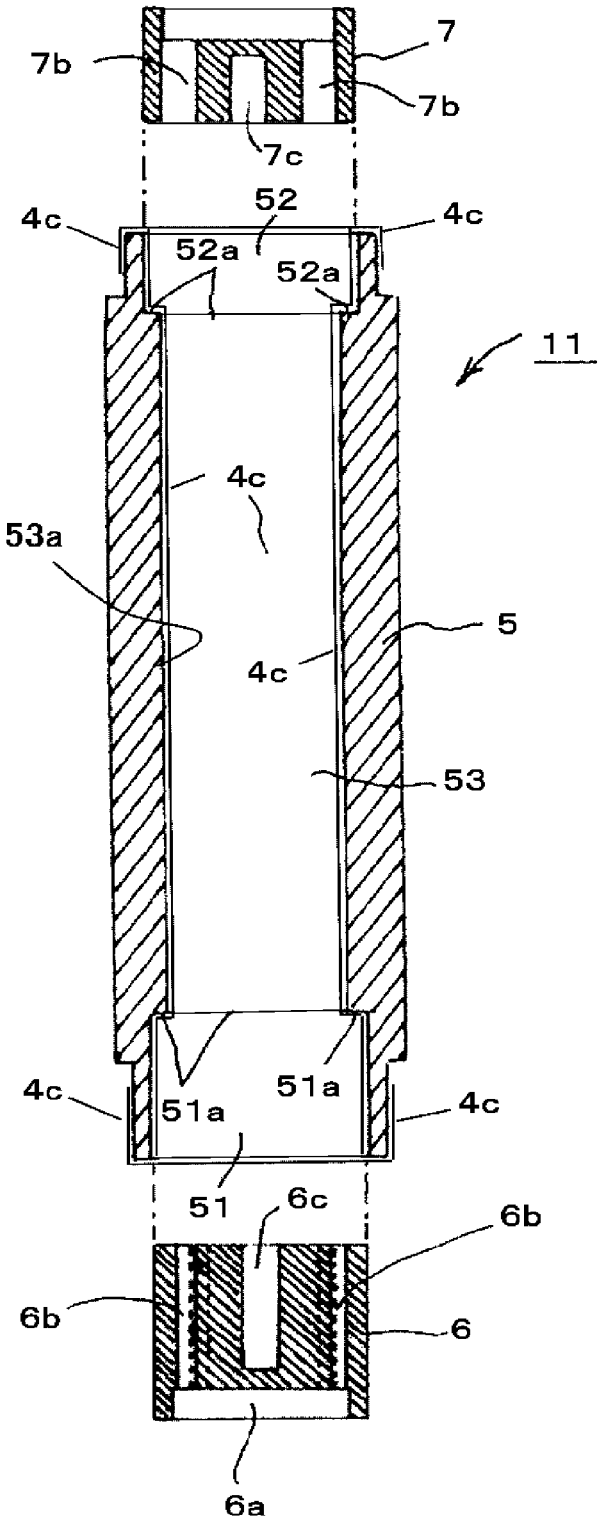
FIG. 11 is a schematic view of a state in which a fluorine-containing resin tube is disposed on an inner surface (forming surface) of the metal mold in advance.

Incidentally, the parting layer 4*c* is not necessarily required to be formed finally in the step, but as shown in FIG. 11, a tube to be formed as the parting layer 4*c* is disposed on an inner wall surface (molding surface) 53*a* of the metal mold 5 in advance. Then the base material 4*a* is disposed inside the metal mold 5 in the manner shown in FIG. 9. In this state, the parting layer 4*c* can be laminated also by casting the liquid composition into the metal mold 11. Further, after the elastic layer 4*b* is formed, it is also possible to form the parting layer 4*c* by a known method such as coating with a fluorine-containing resin material.

Here, a parting agent is applied onto a liquid contact surface of each of the lower piece mold 6 and the upper piece mold 7 in advance, and after the demolding, the liquid rubber remaining in each of the piece molds is removed, and then each of the piece molds is used again. When the parting agent is applied in advance, removal of the cured rubber remaining on the associated piece mold is easy. Also onto the molding surface 53*a* of the hollow metal mold 5, the parting agent is applied, whereby the demolding after the rubber curing becomes easy. Further, in the casting step, the metal mold 11 may also assume a horizontal (lateral) attitude or an upside-down attitude. However, in the horizontal attitude or the upside-down attitude, there is a liability that the air is incorporated during the liquid composition injection, and therefore the attitude in which the injection side is positioned in the lower side is preferable.

(5) Elastic Layer 4*b* of Pressing Roller 4

Figure 4:
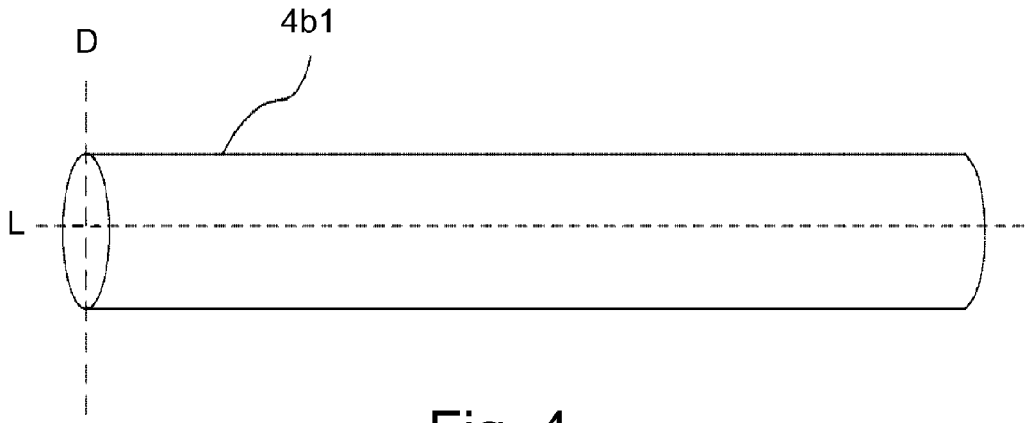
FIG. 4 is a schematic view of a needle-like filler.

Using FIGS. 3 and 4, the elastic layer 4*b* will be described in further detail. FIG. 4 is an enlarged perspective view of the needle-like filler 4*b*1 having a diameter D and a length L. The needle-like filler 4*b*1 is oriented in a planar direction of the base material 4*a* in the elastic layer 4*b*. Incidentally, a physical property and the like of the needle-like filler 4*b*1 will be described later.

In FIG. 3, (a) is an enlarged view of a sample 4*be* cut out from the elastic layer 4*b* shown in FIG. 2 in the neighborhood of a non-sheet-passing portion E. The neighborhood of the non-sheet-passing portion E is a region where the paper does not pass during the sheet passing (i.e., a region where passable maximum-sized paper does not pass). In FIG. 3, (b) is an enlarged view of a sample 4*bs* cut out from the elastic layer 4*b* shown in FIG. 2 at a sheet-passing portion S. The sheet-passing portion S is a region where the maximum-sized paper passes. Each of the cut-out samples 4*be* and 4*bs* is cut out along the axial direction y and the circumferential direction x as shown in FIG. 2.

When the cross-section of the cut-out sample 4*bs* of the sheet-passing portion S with respect to the axial direction and the circumferential direction is observed, in each of the (front) surface side and the core metal side, the needle-like filler 4*b*1 can be observed as being oriented with an average angle of 80 degrees or more and 100 degrees or less with respect to a normal direction to the surface of the pressing roller 4 shown in (b) of FIG. 3.

When the cross-section of the cut-out sample 4*be* in the neighborhood of the non-sheet-passing portion E with respect to the axial direction and the circumferential direction is observed, in each of the surface side and the core metal side, the needle-like filler 4*b*1 is similarly oriented as in the case of (b) of FIG. 3. Further, at the central portion of the non-sheet-passing portion E, the needle-like filler 4*b*1 can be observed as being oriented with an average angle of less than 80 degrees or more than 100 degrees with respect to the normal direction to the surface of the pressing roller 4.

Further, in each of (a) and (b) of FIG. 3, the pore portion 4*b*2 distributed uniformly can be observed.

Next, as constituent elements for representing features of the elastic layer 4*b* shown in FIG. 2, it is possible to cite a base polymer, the pore portion 4*b*2 and the needle-like filler 4*b*1. In the following, these elements will be described in order.

<Base Polymer>

The base polymer of the elastic layer 4*b* is obtained by cross-linking and curing an addition curing type liquid silicone rubber. The addition curing type liquid silicone rubber is an uncross-linked silicone rubber including organopolysiloxane (A) having unsaturated bond such as a vinyl group and organopolysiloxane (B) having Si—H bond (hydride). The cross-linking curing proceeds by addition reaction of Si—H with the unsaturated bond such as the vinyl group by heating or the like. As a catalyst for accelerating the reaction, it is in general to incorporate a platinum compound into the organopolysiloxane (A). Flowability of this addition curing type liquid silicone rubber can be adjusted within a range not impairing an object of the present invention.

<Pore Portion 4*b*2>

In the elastic layer 4*b*, the oriented needle-like filler 4*b*1 and the pore portion 4*b*2 co-exist. For that reason, it is important that the needle-like filler 4*b*1 and the pore portion 4*b*2 can be disposed in a state in which they do not interfere with each other.

As a result of study by the present inventors, depending on a pore-forming means such as pore formation by a foaming agent or pore formation by hollow particles (Japanese Laid-Open Patent Application JP-A 2001-265147), needle-like filler orientation inhibition generated in some cases when the pore formation was made. An orientation state of the needle-like filler dominates the thermal conductivity with respect to the orientation direction, and therefore when the orientation is inhibited, an effect of suppressing the non-sheet-passing portion temperature rise and of shortening a rise time is unpreferably lowered.

On the other hand, in the case where the pore is formed by using the water-containing material in which the water is incorporated into the water absorptive polymer, a degree of the orientation inhibition of the needle-like filler co-existing with the water-containing material can be reduced. A mechanism for compatibly realizing the orientation of the needle-like filler in the axial direction and the pore formation is not clarified. It would be assumed that due to thixotropy exhibiting in the uncross-linked addition curing type liquid silicone rubber in which the needle-like filler and the water-containing material are dispersed (herein, this liquid is referred to as the liquid composition), the water-containing material is lowered in viscosity during flow of the liquid composition, and therefore the orientation of the needle-like filler is not readily inhibited.

Porosity of the elastic layer 4*b* may preferably be 10 volume & or more and 70 volume % or less. By causing the porosity to fall within this range, it is possible to further shorten the rise time.

<Needle-Like Filler 4*b*1>

The needle-like (elongated fiber-shaped) filler 4*b*1 has thermal conductivity anisotropy that heat is easily conducted in the direction in which the needle-like filler 4*b*1 is oriented (i.e., such a characteristic that the thermal conductivity of the needle-like filler with respect to a long-axis (length) direction is higher than that with respect to a short-axis direction. The "needle-like" refers to a shape having a length with respect to one direction compared with other directions, and the shape can be principally expressed by a short-axis diameter and a long-axis length. As shown in FIG. 4, such a material that a ratio of the length L to the diameter D is large, i.e., an aspect ratio is high can be used. A shape of the bottom of the filler may be a circular shape or a rectangular shape, and a material oriented by the above-described molding method is applicable. As such a material, it is possible to use pitch-based carbon fibers.

By incorporating the pitch-based carbon fibers having thermal conductivity $\lambda$ of 500 W/(m·K) or more, an effective pressing roller 4 can be obtained. Further, by causing the pitch-based carbon fibers to have a needle-like shape, the effective pressing roller 4 can be obtained. As a specific shape of the needle-like pitch-based carbon fibers, it is possible to cite a shape of 5 μm-11 μm in diameter D (average diameter (short-axis diameter)) and 100 μm-1000 μm in length L (average length (long-axis length)) in FIG. 4, for example, and such a material is industrially available easily. The long-axis length (average) may preferably be 0.05 mm-5 mm, more preferably 0.05 mm-1.0 mm.

Here, it is desirable that the needle-like filler 4*b*1 is incorporated in the elastic layer 4*b* in an amount of 5 vol. %-40 vol. %. By causing the needle-like filler to have a content in this range, the thermal conductivity of the elastic layer according to the present invention can be improved with reliability. Further, the content in the above range does not readily have the influence on the molding property of the elastic layer due to the incorporation of the needle-like filler.

Incidentally, in the present invention, the filler, a filling agent and a compounding agent which are not described in the present invention may also be incorporated as a means for solving a known problem so long as the content thereof does not exceed the range of the feature of the present invention.

EMBODIMENTS

In each of pressing rollers in Embodiments, the following materials were used. The width Wmax of the maximum (width)-sized sheet capable of being introduced into the fixing device A is a width of 297 mm of the A4-sized sheet (paper) to be fed in a long-edge feeding manner on the so-called center(-line) basis. That is, as shown in FIG. 2, the width of the pressing roller 4 at the sheet-passing portion S is 297 mm. The non-sheet-passing portion E is a portion of about 8 mm in width from each of ends of the pressing roller 4.

1) At the base material 4*a*, an iron-made core metal of 22.8 mm in diameter and 313 mm in axial length of the rubber-laminated portion was used.

2) The water-containing material is prepared by incorporating water into "REOGIC 250H" (manufactured by Toagosei Co., Ltd.). The amount of "REOGIC 250H" was adjusted at 1 wt. % per the water-containing material.

3) As the parting layer 4*c*, a 50 μm-thick PFA fluorine-containing resin tube (manufactured by Gunze Limited) was used.

4) As the needle-like filler 4*b*1, the pitch-based carbon fibers shown below were used. There is also a needle-like filler in which the species and the content (proportion) thereof are changed between the sheet-passing portion S and the non-sheet-passing portion E of the elastic layer 4*b*.

<Trade name: XN-100-05M (manufactured by Nippon Graphite Fiber Co., Ltd.)

Average fiber diameter D: 9 μm

Average fiber length L: 50 μm

Thermal conductivity: 900 W/(m·K)

This needle-like filler is hereinafter referred to as "100-05M".

<Trade name: XN-100-15M (manufactured by Nippon Graphite Fiber Co., Ltd.)

Average fiber diameter D: 9 μm average fiber length L: 150 μm

Thermal conductivity: 900 W/(m·K)

This needle-like filler is hereinafter referred to as "100-15M".

<Trade name: XN-100-01Z (manufactured by Nippon Graphite Fiber Co., Ltd.)

Average fiber diameter D: 10 μm

Average fiber length L: 1 mm

Thermal conductivity: 900 W/(m·K)

This needle-like filler is hereinafter referred to as "100-01Z".

Incidentally, in this embodiment, bonding between the elastic layer 4*b* and the base material 4*a* and between the elastic layer 4*b* and the parting layer 4*c* is made by the following materials. For the bonding between the elastic layer 4*b* and the base material 4*a*, liquid A and liquid B of "DY39-051" (trade name, manufactured by Dow Corning Toray Co., Ltd.) was used, and for the bonding between the elastic layer 4*b* and the parting layer 4*c*, liquid A and liquid B of "SE1819CV" (trade name, manufactured by Dow Corning Toray Co., Ltd.) was used.

In this embodiment, the following steps were performed. In a liquid composition compounding step, the liquid composition was obtained using various materials as described above. Then, the liquid composition was mixed by a universal mixing and stirring device, and the liquid composition for forming the elastic layer was casted into a pipe-shaped cylindrical mold of 30 mm in diameter in which a primer-treated base material 4*a* was disposed, and then the mold was hermetically sealed.

Figure 12:
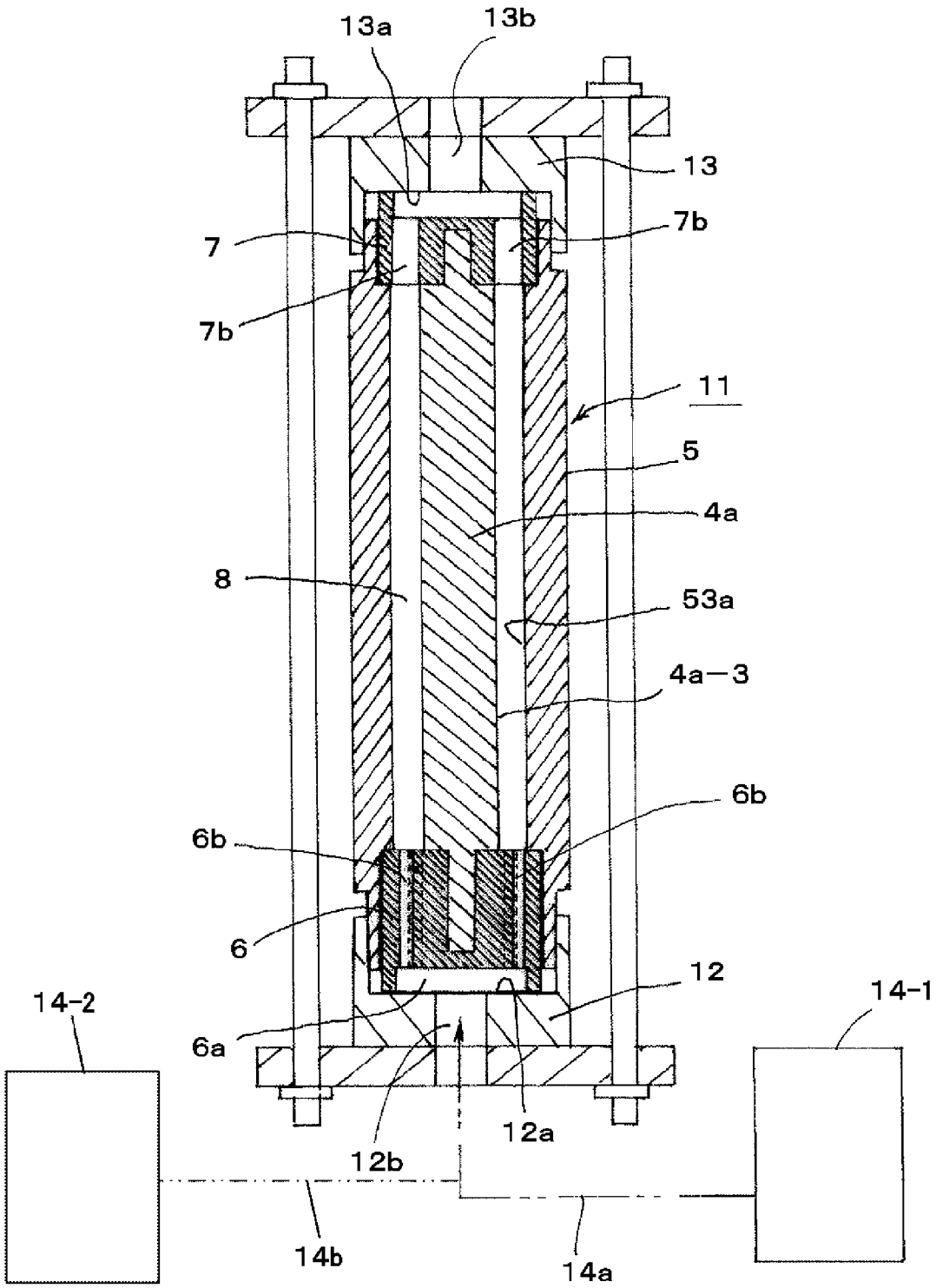
FIG. 12 is an illustration of another injection step.

Incidentally, in the case where the needle-like filler is changed between the sheet-passing portion S and the non-sheet-passing portion E, a liquid composition A for the sheet-passing portion and a liquid composition B for the non-sheet-passing portion are prepared. Then, into an initial (injection) portion corresponding to the non-sheet-passing portion E, the liquid composition B is injected from a first feeding device 14-1 through a feeding pipe 14*a* as shown in FIG. 12. Into an intermediary portion corresponding to the sheet-passing portion S, the liquid composition A was injected from a second feeding device 14-2 through a feeding pipe 14*b*. Then, into a final portion corresponding to the non-sheet-passing portion E, the liquid composition B was injected again from the first feeding device 14-1 through the feeding pipe 14*a*.

In a silicone rubber component curing step, heat treatment was performed in a hot-air oven under a condition of 90° C. and 1 hour. Then, in a dewatering step, water cooling and demolding were made in advance and the heat treatment was performed in the hot-air oven under a condition of 200° C. and 4 hours. Finally, as the parting layer 4*c*, the PFA fluorine-containing resin material was coated on the elastic layer 4*b* by using the above-described adhesive (bonding agent).

Embodiment 1

In an uncross-linked addition curing type liquid silicone rubber, 5 vol. % of the needle-like filler "100-05M" and 10 vol. % of the water-containing material were mixed. Then, the liquid composition for forming the elastic layer was casted into the pipe-shaped cylindrical mold in which the base material 4*a* was disposed and then subjected to the steps of the cross-linking, the demolding and the dewatering, so that the elastic layer 4*b* was formed. Then, the parting layer 4*c* was formed by coating the PFA resin tube on the elastic layer 4*b* by using the adhesive. In this way, a pressing roller 4 in Embodiment 1 was obtained.

Embodiment 2

A pressing roller 4 in Embodiment 2 was obtained by formulation shown in Table 1 appearing hereinafter in a manner similar to that in Embodiment 1.

Embodiment 3

The liquid composition A in which 25 vol. % of the needle-like filler "100-15M" and 30 vol. % of the water-containing material were mixed in the uncross-linked addition curing type liquid silicone rubber, and the liquid composition B in which 3 vol. % of the needle-like filler "100-05M" and 30 vol. % of the water-containing material were mixed in the uncross-linked addition curing type liquid silicone rubber were prepared. Then, in the manner described with reference to FIG. 12, the elastic layer was molded by the casting.

That is, the liquid composition B and the liquid composition A were casted into the pipe-shaped cylindrical mold in which the base material 4*a* was disposed in such a manner that the liquid composition B was injected into the portion corresponding to the non-sheet-passing portion E which was 8 mm from each of the ends of the pressing roller 4 and that the liquid composition A was injected into the portion, corresponding to the sheet-passing portion S, other than the portion corresponding to the non-sheet-passing portion E (FIG. 12). Then, the liquid compositions were subjected to the above-described steps of the cross-linking, the demolding and the dewatering, so that the elastic layer 4*b* was formed. Then, the parting layer 4*c* was formed by coating the PFA resin tube on the elastic layer 4*b* by using the adhesive. In this way, a pressing roller 4 in Embodiment 3 was obtained. That is, the pressing roller 4 in Embodiment 3 contains the needle-like filler, in the elastic layer 4*b*, which is larger in aspect ratio (average aspect ratio) at the sheet-passing portion S than at the non-sheet-passing portion E.

Embodiment 4

A pressing roller 4 in Embodiment 4 was obtained by formulation shown in Table 1 appearing hereinafter in a manner similar to that in Embodiment 3.

Comparison Example 1

A pressing roller 4 in Comparison Example 1 was obtained in the same manner as in Embodiment 3 except that the above-described liquid composition was not used but an addition curing type silicone rubber of 0.4 W/(m·K) in thermal conductivity was used for the elastic layer 4*b*.

Comparison Example 2

In the case where a liquid composition in which 45 vol. % of the needle-like filler "100-01Z" and 45 vol. % of the water-containing material were mixed was used in the same manner as in Embodiment 1, it was difficult to mold the liquid composition, so that a pressing roller in Comparison Example 2 suitable for evaluation was unable to be obtained.

Comparison Example 3

In the case where a liquid composition in which 5 vol. % of the needle-like filler "100-05M" and 80 vol. % of the water-containing material were mixed was used in the same manner as in Embodiment 1, it was difficult to mold the liquid composition, so that a pressing roller in Comparison Example 3 suitable for evaluation was unable to be obtained.

(Evaluation Method)

<Thermal Conductivity with Respect to Planar Direction and Thickness Direction>

Measurement of the thermal conductivity of the cut-out sample 4*bs* ((b) of FIG. 3) of the elastic layer 4*b* at the sheet-passing portion S of the pressing roller 4 was made in the following manner.

Figure 5:
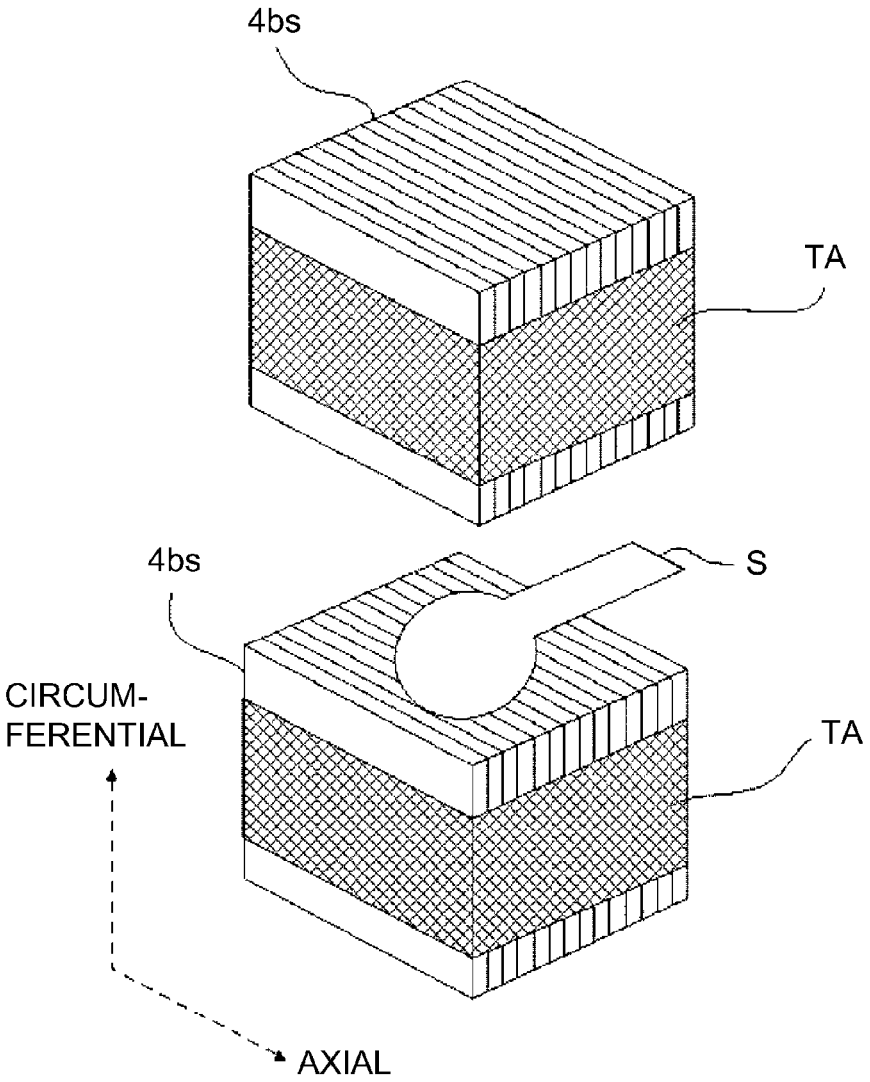
FIG. 5 is an illustration of thermal conductivity measurement of the cut sample of an elastic layer.

In this measuring example, first, the thermal conductivity measurement with respect to a widthwise direction as the planar direction was made. Using FIG. 5, the thermal conductivity measurement with respect to the axial direction y and the thickness direction z of the elastic layer 4*b* of the pressing roller 4 will be described. FIG. 5 shows a sample for thermal conductivity evaluation prepared by superposing cut-out samples 4*bs* each having a size of 15 mm (circumferential direction x)×15 mm (axial direction y)×set thickness (thickness direction z) so as to have a thickness of about 15 mm.

When the thermal conductivity was measured, as shown in FIG. 5, the sample to be measured was fixed by a tape TA of 0.07 mm in thickness and 10 mm in width to prepare a set of the samples 4*bs*. Then, in order to uniformize flatness of the surface to be measured, the surface to be measured and an opposite surface thereof are cut with a razor. In this way, two sample sets to be measured are prepared, and a sensor S is sandwiched between the two sample sets, and then measurement was made. For measurement, a hot disk method thermophysical property measuring device ("TPA-501, manufactured by Kyoto Electronics Manufacturing Co., Ltd.).

When the thermal conductivity with respect to the thickness direction z was measured, the direction of the sample to be measured was changed and then the measurement was made in the same manner as described above. Incidentally, in this embodiment, using an average value of 5 times of measurement with respect to each of the planar direction and the thickness direction, a ratio $\alpha$ of a planar direction thermal conductivity $\lambda 1$ to a thickness direction thermal conductivity $\lambda 2$ was calculated.

Measurement of the thermal conductivity with respect to the thickness direction of the cut-out sample 4*be* at the non-sheet-passing portion E of the pressing roller 4 was made. Using FIG. 5, the thermal conductivity measurement with respect to the thickness direction z at the non-sheet-passing portion E will be described. FIG. 5 shows a sample for thermal conductivity evaluation prepared by superposing cut-out samples 4*bs* each having a size of 5 mm (circumferential direction x)×5 mm (axial direction y)×set thickness (thickness direction z) so as to have a thickness of 5 mm.

When the thermal conductivity was measured, as shown in FIG. 5, the sample to be measured was fixed by a tape TA of 0.07 mm in thickness and 3 mm in width to prepare a set of the samples 4*be*. Then, in order to uniformize flatness of the surface to be measured, the surface to be measured and an opposite surface thereof are cut with a razor. In this way, two sample sets to be measured are prepared, and a sensor S is sandwiched between the two sample sets, and then measurement was made. For measurement, the hot disk method thermophysical property measuring device ("TPA-501, manufactured by Kyoto Electronics Manufacturing Co., Ltd.).

Using an average value of 5 times of measurement, a thermal conductivity $\lambda 3$ with respect to the thickness direction z was calculated. Further, a ratio $\beta$ of the thermal conductivity $\lambda 3$ with respect to the thickness direction z of the cut-out sample 4*be* of the elastic layer 4*b* at the non-sheet-passing portion E to the thermal conductivity $\lambda 2$ with respect to the thickness direction z of the cut-out sample 4*bs* of the elastic layer 4*b* at the sheet-passing portion S was calculated.

<Non-Sheet-Passing Portion Temperature Rise>

For evaluation of the non-sheet-passing portion temperature rise, fixing devices A of the film heating type shown in FIG. 1 in which the pressing rollers, 4 were mounted in Embodiments 1 to 4 and Comparison Example 1, prepared in the above-described manners were used.

A peripheral speed of each of the pressing rollers 4 mounted in the fixing devices A was adjusted at 234 mm/sec, and a heater temperature was set at 190° C. In an environment of 15° C. in temperature and 15% in humidity, 500 sheets of A4-sized paper ("GF-C104, available from Canon Inc.) were continuously fed in a short edge (210 mm in width) feeding. A surface temperature of the fixing film 3 in the non-sheet-passing portion region (the region where a portion of the A4-sized paper (short edge feeding) does not pass through the sheet-passing portion S (297 mm in width) was measured using an infrared thermography ("FSV-7000S", manufactured by Apiste Corp.).

<Rise Time>

Evaluation of a rise time of the fixing device A was made by measuring a time from turning-on of a heater switch until the surface temperature of the fixing film 3 reached 180° C. in an idling state in which the sheet was not passed through the fixing device A.

TABLE 1

| | Needle-like filler | | | | | | | | | | | | |
|---|---|---|---|---|---|---|---|---|---|---|---|---|---|
| | SPR*1 | | NSPR*2 | | | SPR*1 | | | TDTC*7 | | | | |
| | | | | | | TC*3 | | | NSPR*2 | SPR*1 | | | |
| | Species | Content (vol. %) | Species | Content (vol. %) | Porosity (vol. %) | TD*4 (W/(m.K)) | PD*5 (W/(m.K)) | TDRα*6 (PD/TD) | TD*4 (W/(m.K)) | TD*4 (W/(m.K)) | TDRβ*8 (NSPR/SPR) | NSPPT*9 (° C.) | Rise Time (sec.) |
| EMB. 1 | 100-05M | 5 | 100-05M | 5 | 20 | 0.39 | 2.70 | 6.9 | 2.13 | 0.39 | 5.5 | 222 | 22.2 |
| EMB. 2 | 100-15M | 25 | 100-15M | 25 | 25 | 0.33 | 10.11 | 30.6 | 2.64 | 0.33 | 8.0 | 220 | 21.1 |
| EMB. 3 | 100-15M | 25 | 100-05M | 3 | 30 | 0.34 | 10.13 | 29.8 | 2.04 | 0.34 | 6.0 | 225 | 19.5 |
| EMB. 4 | 100-01Z | 40 | 100-05M | 3 | 30 | 0.26 | 86.71 | 333.5 | 2.02 | 0.26 | 7.8 | 227 | 18.8 |
| COMP. EX. 1 | — | — | — | — | 0 | 0.43 | 0.42 | 1.0 | 0.43 | 0.43 | 1.0 | 286 | 23.8 |

*1"SPR" is the sheet-passing region.
*2"NSPR" is the non-sheet-passing region.
*3"TC" is the thermal conductivity.
*4"TD" is the thickness direction.
*5"PD" is the planar direction.
*6"TDRα" is the thermal conductivity ratio.
*7"TDTC" is the thickness direction thermal conductivity.
*8"TDRβ" is the thermal concuctivity ratio.
*9"NSPPT" is the non-sheet-passing portion temperature.

<Evaluation Result>

In Table 1, the species, the content and the porosity of the needle-like filler 4*b*1 which is the heat-conductive filler were shown. Further, an evaluation result of the planar direction thermal conductivity λ1, the thickness direction thermal conductivity λ2 and the thermal conductivity ratio α of the planar direction thermal conductivity λ1 to the thickness direction thermal conductivity λ2 at the sheet-passing portion S, and the thickness direction thermal conductivity λ3 at the non-sheet-passing portion E, the thermal conductivity ratio β of λ3 to λ2, a non-sheet-passing portion temperature and the rise time was shown.

In Comparison Example 1, the non-sheet-passing portion temperature was 286° C., and the rise time was 23.8 sec. The non-sheet-passing portion temperature of 286° C. was high temperature and exceeded 230° C. which is an endurance rupture temperature, so that a desired non-sheet-passing portion temperature rise suppressing effect was unable to be obtained. The rise time was 23.8 sec., so that a desired rise time shortening effect was unable to be obtained. In Comparison Example 1, the heat conduction has no anisotropy, and therefore, the ratio α of the planar direction thermal conductivity λ1 to the thickness direction thermal conductivity λ2 is approximately 1.

In Embodiment 1, the non-sheet-passing portion temperature was 222° C., so that the non-sheet-passing portion temperature rise suppression was confirmed. Further, the rise time was 22.2 sec., so that also the rise time shortening effect was confirmed. The thermal conductivity ratio α at the sheet-passing portion S is 6.9, and the thermal conductivity ratio β with respect to the thickness direction between the non-sheet-passing portion E and the sheet-passing portion S is 5.5.

In Embodiment 2, the non-sheet-passing portion temperature was 220° C., so that the non-sheet-passing portion temperature rise suppression was confirmed. Further, the rise time was 21.1 sec., so that also further improvement in the rise time shortening effect was confirmed. The thermal conductivity ratio α at the sheet-passing portion S is 30.6, and the thermal conductivity ratio β with respect to the thickness direction between the non-sheet-passing portion E and the sheet-passing portion S is 8.0. It would be considered that the rise time is shortened since the thermal capacity of the elastic layer 4*b* is lowered by increasing the porosity.

Also in Embodiments 3 and 4, as shown in the result of Table 1, the non-sheet-passing portion temperature rise suppressing effect and the rise time shortening effect were confirmed.

The elastic layer 4*b* of the pressing roller 4 has the pores, and therefore is low in thermal capacity and is good in heat insulating property. Further, in the elastic layer 4*b* at the sheet-passing portion S, the needle-like filler 4*b*1 is oriented in the planar direction xy, and therefore the heat conduction in the thickness direction z can be suppressed.

The ratio α=λ1/λ2 (the planar direction thermal conductivity λ1/the thickness direction thermal conductivity λ2) is 6 or more and 900 or less. When the thermal conductivity ratio α is less than 6, the non-sheet-passing portion temperature rise suppressing effect cannot be obtained sufficiently, and in order to increase the thermal conductivity ratio α to more than 900, the amount and the porosity of the needle-like filler are increased, so that it is difficult to effect machining and molding. Therefore, it would be considered that the heat of the fixing film 3 does not readily conduct to the pressing roller 4. As a result, it becomes possible to shorten the rise time.

Further, in the elastic layer 4*b* of the pressing roller 4 at the non-sheet-passing portion E, the needle-like filler 4*b*1 is oriented also in the thickness direction z. For that reason, the heat accumulated in the elastic layer 4*b* by the non-sheet-passing portion temperature rise at the non-sheet-passing portion E when the small-sized sheet is continuously passed conducts to the core metal (base material) 4*a* of the pressing roller 4 via the elastic layer 4*b* at the non-sheet-passing portion E. The core metal 4*a* is large in thermal capacity and is good in thermal conductivity, and therefore it is possible to suppress temperature non-uniformity of the pressing roller 4 with respect to the longitudinal direction.

Here, the needle-like filler to be incorporated into the elastic layer 4*b* may also be a mixture of a plurality of species of needle-like fillers different in (average) aspect ratio.

The constitution of the above-described pressing roller 4 is summarized as follows. The pressing roller 4 includes the base material 4*a* and the elastic layer 4*b* formed on the base material 4*a*, and is the nip-forming member for forming the nip N, where the sheet-like recording material on which the toner image T is carried is nip-fed and heated, by elastic deformation of the elastic layer 4*b* caused by press-contact with the heating member 3.

The elastic layer 4*b* is a porous elastic layer containing the needle-like filler 4*b*1 and the porous portion 4*b*2. With respect to the longitudinal direction of the pressing roller (nip-forming member) 4, the portion corresponding to the width of the recording material P, having the maximum (width) size Wmax, capable of being introduced into the nip N is the sheet-passing portion region S, and the portion outside the sheet-passing portion region S is the non-sheet-passing portion region E. The thermal conductivity λ3 with respect to the thickness direction z of the elastic layer 4*b* in the non-sheet-passing portion region E is higher than the thermal conductivity λ2 with respect to the thickness direction z of the elastic layer 4*b* in the sheet-passing portion region S. The thermal conductivity λ1 with respect to the planar direction xy of the elastic layer 4*b* in the sheet-passing portion region S is 6 times or more and 900 times or less the thermal conductivity λ2 with respect to the thickness direction z. The pressing roller 4 has the above-described features.

Based on these features, it is possible to compatibly realize the non-sheet-passing portion temperature rise suppression and the rise time shortening when the small-sized recording material is continuously introduced into the fixing device.

Embodiment 5

Pressing rollers in this embodiment (Embodiment 5) and Embodiments 6 and 7 described later are, compared with the pressing rollers 4 in Embodiments 1 to 4, further capable of suppressing a so-called trailing end leap of the sheet (recording material) P introduced into the nip N.

In the pressing rollers 4 in Embodiments 1 to 4, as described above, the elastic layer 4*b* is the porous elastic layer having the porous portion (pores) 4*b*2 for lowering the thermal capacity. For that reason, in the case where the temperature increases, the elastic layer 4*b* is liable to expand in the thickness direction z. When the small-sized sheet is continuously passed, a diameter of the pressing roller portion corresponding to the non-sheet-passing portion becomes larger than a diameter of the pressing roller portion corresponding to the sheet-passing portion of the small-sized sheet due to the expansion of the elastic layer 4*b* caused by the non-sheet-passing portion temperature rise. That is, a degree of the expansion of the pressing roller 4 in the longitudinal end portion side becomes larger than that at the longitudinal central portion. For that reason, the nip width with respect to the sheet feeding direction in the longitudinal end portion side of the nip N becomes larger than the nip width at the longitudinal central portion.

In this state, when a sheet larger in width than the small-sized sheet which has been passed until then is passed, in the nip N, a feeding speed of the sheet at a widthwise end portion becomes higher than a feeding speed of the sheet at a widthwise central portion. For that reason, in some cases, the trailing end leap of the sheet and image defect (such as wrinkle image, density non-uniformity or uneven glossiness at the sheet trailing end portion) with the trailing end leap are generated. Specifically, when the sheet is nip-fed through the nip N, the sheet is pulled in the widthwise direction in one end side and in the other end side, whereby a load is exerted on the sheet in a side upstream of the nip N with respect to the sheet feeding direction and thus widthwise end portions of the sheet are raised.

In this state, when the sheet trailing end passes through a transfer portion 35, the sheet trailing end portion leaps, so that image disturbance due to scratch of the toner image by the feeding member and contact of the toner image with the fixing film 3 in the front side of the nip N is liable to generate.

In order to reduce a degree of the image defect due to the trailing end leap, in the pressing rollers in this embodiment and Embodiments 6 and 7 described later, the thickness of the elastic layer 4*b* which is the porous elastic layer containing the needle-like filler 4*b*1 and the porous portion 4*b*2 becomes thick from the longitudinal central portion toward the longitudinal end portions. Based on this feature, it is possible to not only compatibly realize the non-sheet-passing portion temperature rise suppression and the rise time shortening but also reduce the degree of the image defect due to the trailing end leap when the small-sized recording material is continuously introduced.

Figure 13:
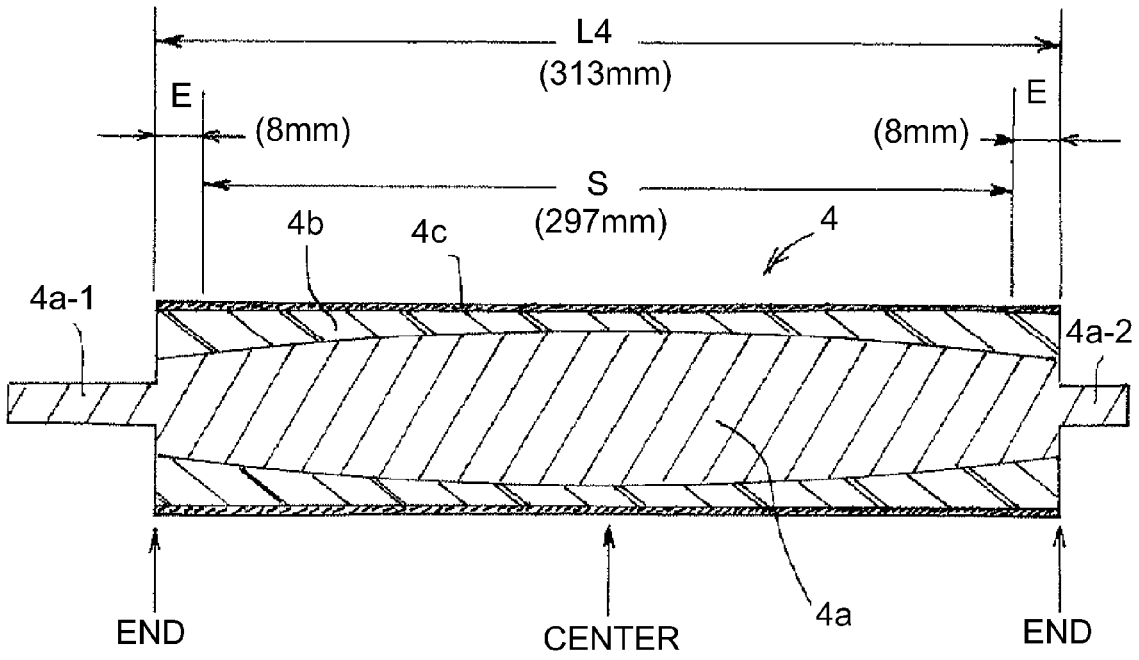
FIG. 13 is a schematic longitudinal sectional view of a pressing roller in Embodiment 5.

FIG. 13 is a schematic longitudinal sectional view of the pressing roller 4 in Embodiment 5. The core metal 4*a* which is the base material has such a crown shape (such a shape that the thickness of the base material 4*a* with respect to the axial direction is thicker at the central portion than at the end portions) that the core metal 4*a* is thicker at the longitudinal central portion than at the longitudinal end portions. An outer diameter of the core metal 4*a* is 24 mm at a center position and is 23 mm at extreme ends (longitudinal ends). The material used is SUS. The thickness of the elastic layer 4*b* is different between the longitudinal central portion and the longitudinal end portions, and is 3 mm at the central portion and is 3.5 mm at the end portions. Accordingly, the pressing roller 4 has a straight shape, in a free state, that an outer diameter is 30 mm along the longitudinal direction. Incidentally, FIG. 12 is an exaggerated view, in which a dimension ratio and the crown shape do not correspond to the above-described numerical values.

The elastic layer 4*b* is the porous elastic layer containing the needle-like filler 4*b*1 and the porous portion 4*b*2 similarly as in Embodiments 1 to 4. In this embodiment, as the high heat-conductive filler, a needle-like carbon filler was used. A dispersion content thereof was about 30 vol. %. Similarly as in Embodiments 1 to 4, the high heat-conductive filler 4*b*1 is oriented in the axial direction of the pressing roller 4, so that the thermal conductivity of the pressing roller 4 with respect to the axial direction is made higher than the thermal conductivity of the pressing roller 4 with respect to the thickness direction. Further, by forming the porous portion 4*b*2 in the elastic layer 4*b*, a low thermal capacity is realized. The manufacturing method of the pressing roller 4 is similar to that in Embodiment 1.

Incidentally, the content, the average length and the thermal conductivity of the needle-like filler described above can be obtained in the following manners. In a measuring method of the content (volume %) of the needle-like filler 4*b*1 in the elastic layer 4*b*, first, an arbitrary portion of the elastic layer 4*b* is cut away, and a volume of the cut-away portion at 25° C. is measured by an immersion specific gravity meter ("SGM-6", manufactured by Mettler-Toredo International Inc.) is used (hereinafter, this volume is referred to as "Vail"). Then, the evaluation sample subjected to the volume measurement is heated at 700° C. for 1 hour in an nitrogen gas atmosphere by using an apparatus for thermogravimetry (trade name: "TGA851e/SDTA", manufactured by Mettler-Toredo International Inc.), so that the silicone rubber component is decomposed and removed.

In the case where in addition to the needle-like filler 4*b*1, an inorganic filler is incorporated in the elastic layer 4*b*, a residual matter after the decomposition is in a state in which the needle-like filler and the inorganic filler exist in mixture. In this state, the volume at 25° C. is measured a dry-type automatic density meter (trade name: "AccuPyc 13301", manufactured by Shimadzu Corp.) (hereinafter, this volume is referred to as "Va").

Thereafter, the residual matter is heated at 700° C. for 1 hour in an air atmosphere, so that the needle-like filler **4*b*1 is thermally decomposed and removed. The volume of the remaining inorganic filler at 25° C. is measured using the dry-type automatic density meter (trade name: "AccuPyc 1330-1", manufactured by Shimadzu Corp.) (hereinafter, this volume is referred to as "Vb"). Based on these values, the weight of the needle-like filler 4*b*1** can be obtained from the following equation:

$$\text{Volume (volume \%) of needle-like filler } 4b1=\{(Va-Vb)/V\text{all}\}\times 100.$$

The average length of the needle-like filler **4*b*1 can be obtained by an ordinary method through microscopic observation of the needle-like filler 4*b*1** after the removal of the silicone rubber component by heat described above.

The thermal conductivity of the needle-like filler can be obtained from:

(a) The thermal diffusivity by a laser flash method thermal constant measurement system (trade name: "TC-7000", ADVANCE RIKO, Inc.)

(b) Specific heat at constant pressure by a differential scanning calorimeter (trade name: "DSC", manufactured by Hitachi High-Tech Science Corp.)

(c) Density by the dry-type automatic density meter (trade name: "AccuPyc 1330-1", manufactured by Shimadzu Corp.)

A calculation formula is as follows:

$$\text{Thermal conductivity}=\text{Thermal diffusivity}\times\text{Density}\times\text{Specific heat}$$

The pressing roller in which the above-described filler is placed was subjected to measurement of the thermal conductivity.

In this embodiment, the specific gravity was measured by the above-described differential scanning calorimeter (DSC). In this measurement, a sample temperature was set at 30° C.-70° C. to measure the specific gravity, and a measured value when the sample temperature was 50° C. was employed as the specific gravity of the sample.

The density was measured by the above-described "AccuPyc 1330-1". The density has a small temperature dependency, and therefore the measurement was made at room temperature.

The thermal diffusivity was measured by a thermal diffusivity meter (trade name: "ai-Phase Mobile 1u/2", available from Hitachi High-Tech Science Corp.). Compared with the laser flash method, the "ai-Phase Mobile 1u/2" is capable of measuring the thermal conductivity of a thick sample (e.g., about 4 mm in thickness).

In the thermal diffusivity measurement using the "ai-Phase Mobile 1u/2", the measurement can be made with respect to an arbitrary direction, so that even when the thermal conductivity has anisotropy as in the case of the pressing roller in this embodiment, the thermal diffusivity is measurable with respect to each of the directions.

For the measurement of the thermal diffusivity, there is a need to take out the sample. In this embodiment, the sample is cut out so as to be 2 mm in thickness with respect to the axial direction, 2 mm in thickness with respect to the circumferential direction and about 2 mm in thickness with respect to the thickness direction, and then the measurement of the thermal diffusivity was made. In a state of 50° C. in sample temperature, the thermal diffusivity measurement was made 5 times, and an average of the measured values was used as the thermal diffusivity of the pressing roller with respect to the axial direction. Further, with respect to the specific gravity and the density, these values are substantially unchanged when dispersibility of the filler over the entire pressing roller region is good. Accordingly, when verification was made, a cut-out position may be an arbitrary position. In this embodiment, the sample was cut out from the elastic layer at a center position and then was subjected to measurement of the specific gravity and the density.

In the measurement of the thermal diffusivity, the samples at the center portion and at a position of 149 mm from the center portion were cut out. The position of 149 mm from the center portion means that the position is outside of the maximum paper size (A4 long edge feeding). A factor relating to the trailing end leap is thermal expansion in a side outside the maximum-sized paper, and therefore two axial direction thermal conductivity values of the rubber samples cut out at the center portion and the position of 149 mm from the center portion were measured, so that it turned out that the thermal conductivity is higher the central portion than at the end portions.

The axial direction thermal conductivity at the center position was 2 W/m·K. On the other hand, the axial direction thermal conductivity at the position of 149 mm from the center portion was 0.4 W/m·K. This means that the orientation of the high heat-conductive filler changes between the center portion and the end portions. The orientation property with respect to the axial direction is high at the center portion and is low at the end portions.

In order to obtain a sufficient non-sheet-passing portion temperature rise suppressing effect, it is desirable that the axial direction thermal conductivity at the center position is 2 W/m·K or more. Further, at the end portions (the position of 149 mm from the center portion in this embodiment), the axial direction thermal conductivity may desirably be 0.4 W/m·K or less. When the axial direction thermal conductivity is 0.4 W/m·K or less, the filler is not substantially oriented in the axial direction, and therefore the thermal expansion during the non-sheet-passing portion temperature rise is easily suppressed.

The high heat-conductive filler is oriented in the axial direction at the center position but is less oriented in the axial direction at the position of 149 mm from the center portion. This is attributable to such a characteristic that the filler is easily oriented in the axial direction in the neighborhood of the core metal and the surface layer. An effect thereof readily exhibits with a thinner rubber, and therefore by changing the rubber thickness between the central portion and the end portions, it is possible to create such a state that the orientation is strong at the central portion and is weak at the end portions.

The orientation of the filler is different between the central portion and the end portions, and therefore ease of the thermal expansion is different between the central portion and the end portions. At the central portion where the filler is oriented in the axial direction, the elastic layer does not readily expand in the axial direction which is the direction of the filler and on the other hand, the elastic layer readily expand thermally in the thickness direction. In contrast thereto, at the position of 149 mm from the center portion, the axial direction orientation of the filler is weak, so that the elastic layer does not readily expand thermally in the thickness direction compared with the central portion.

The pressing roller 4 in this embodiment is, compared with a conventional high heat-conductive porous pressing roller, characterized in that a countermeasure against the end portion leap is taken while maintaining the non-sheet-passing portion temperature rise suppressing effect. At the end portions, the orientation property of the filler 4*b*1 lowers, and therefore the axial direction thermal conductivity is low, but inside the maximum-sized paper, the thermal conductivity comparable to the axial direction thermal conductivity of the conventional high heat-conductive porous pressing roller is obtained.

In the case where the small-sized paper is passed, a factor effective in suppressing the non-sheet-passing portion temperature rise is the thermal conductivity of the elastic layer at a portion inside the maximum-sized paper in most cases. Accordingly, when the small-sized paper is continuously passed, a degree of the non-sheet-passing portion temperature rise is comparable to that of the conventional pressing roller.

The above-described fixing device was subjected to a trailing end leap evaluation experiment during continuous printing. An evaluation method is as follows. First, 30-120 sheets of A4R-sized paper (A4 short edge feeding, width: 210 mm) were passed to cause the non-sheet-passing portion temperature rise. Thereafter, one sheet of A3-sized paper (A3 short edge feeding, width: 297 mm) was passed, and then the presence or absence of the trailing end leap was discriminated. In the case where the trailing end leap generated, the image defect generated, and therefore "OK" and "NG" were discriminated by visual observation.

After the A4R-sized paper was passed at 30 ppm in a condition of a process speed of 250 mm/sec, one sheet of the A4-sized paper on which the unfixed image was passed. The experiment was conducted in 4 patterns of 30 sheets, 60 sheets, 90 sheets and 120 sheets in the number of sheets subjected to continuous sheet passing. The surface temperature of the feeding 3 at the central portion was 170° C., and "CF-0081" was used as the paper.

The non-sheet-passing portion temperature was 190° C. when the continuously passed sheet number was 30 sheets, 210° C. when the sheet number was 60 sheets, 225° C. when the sheet number was 90 sheets, and 230° C. when the sheet number was 120 sheets.

By conducting the experiment while changing the non-sheet-passing portion temperature, ease of generation of the trailing end leap can be changed. In general, the trailing end leap is liable to generate when the non-sheet-passing portion temperature is higher. This is because a degree of expansion of a temperature rise portion becomes large when the end portion temperature becomes high and a diameter of the portion becomes large correspondingly.

Such a trailing end leap evaluation experiment was conducted using the pressing roller 4 in this embodiment (FIG. 5) and a high heat-conductive porous pressing roller, as the pressing roller in Comparison Example, in which the thickness of the elastic layer 4*b* of the pressing roller is the same over the longitudinal central portion and the longitudinal end portions.

Figures 15, 16:
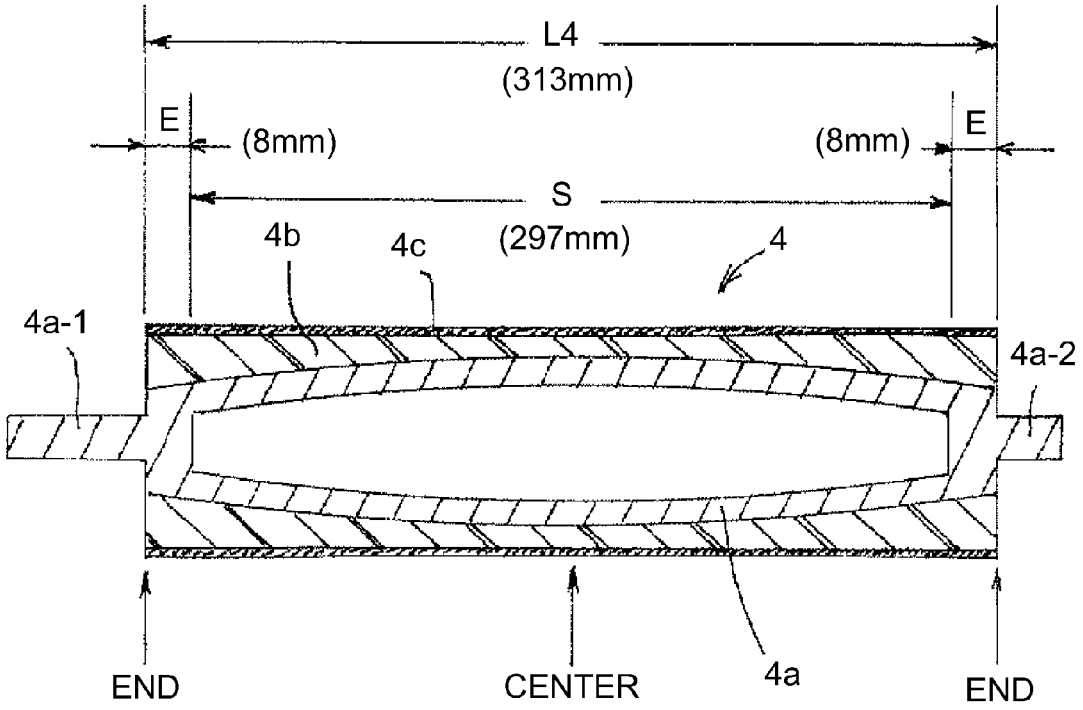
FIG. 15 is a schematic longitudinal sectional view of a pressing roller in Embodiment 7.
FIG. 16 is a table showing an evaluation experiment result of Embodiments 5-7 and Comparison Example.

An evaluation result of the trailing end leap was shown in FIG. 16. In Comparison Example, the image defect due to the trailing end leap generated at the non-sheet-passing portion temperature of 225° C. or more, but in the case of the pressing roller 4 in Embodiment 5, even at the non-sheet-passing portion temperature of 230° C., the image defect due to the trailing end leap did not generate.

Embodiment 6

Figure 14:
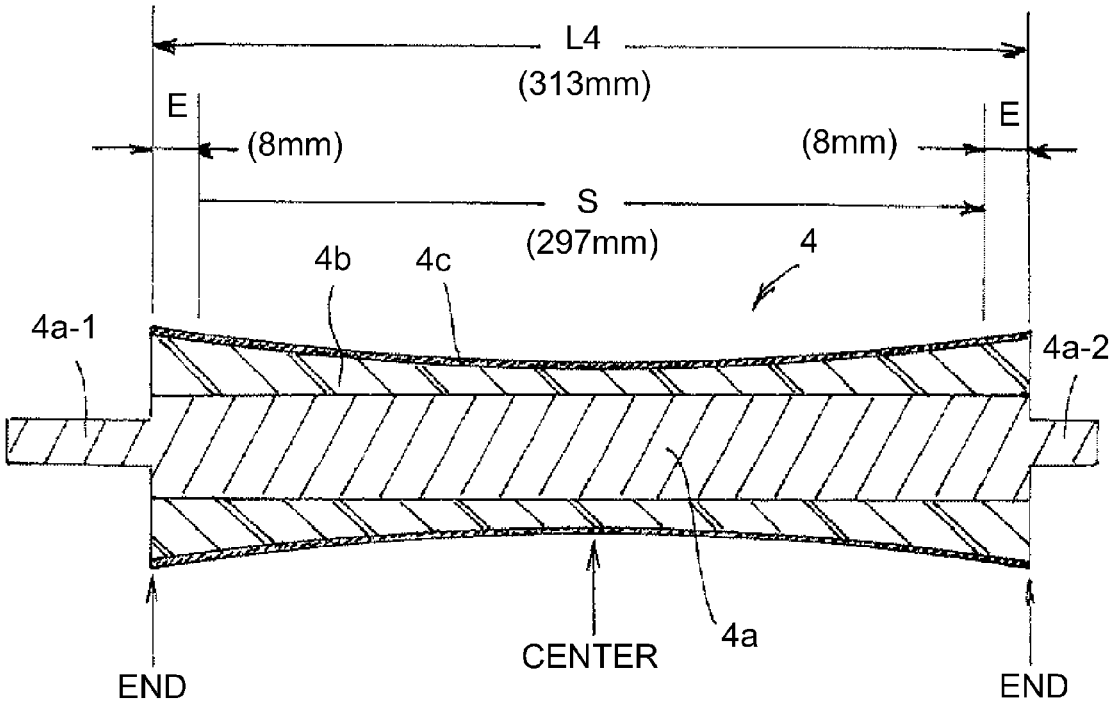
FIG. 14 is a schematic longitudinal sectional view of a pressing roller in Embodiment 6.

FIG. 14 is a schematic sectional view of a pressing roller 4 in Embodiment 6. A core metal 4*a* which is the base material has a straight shape along a longitudinal direction (i.e., such a straight shape that the axial direction thickness of the base material 4*a* in the same), and an outer diameter thereof was 24 mm. An elastic layer 4*b* has such a reverse crown shape that the thickness is different between a center position and a position of 149 mm from the center, so that the elastic layer thickness was 3 mm at the center position and was 3.5 mm at the position of 149 mm from the center. That is, the outer diameter of the pressing roller 4 assumes the reverse crown shape. This shape is a good shape against paper creases.

Incidentally, also FIG. 14 is an exaggerated view, in which a dimensional ratio and the reverse crown shape do not correspond to the above-described numerical values. The elastic layer 4*b* is the porous elastic layer containing the needle-like filler 4*b*1 and the pore portion 4*b*2 similarly as in Embodiments 1 to 4. A manufacturing method of the pressing roller 4 is similar to that in Embodiment 1.

Even in the pressing roller having such a shape, the elastic layer 4*b* is thicker at the end portions than at the center position, and therefore a degree of orientation of the high heat-conductive filler is larger at the center position than at the end portions where the rubber is thick.

A fixing device using the pressing roller 4 in this embodiment (Embodiment 6) was subjected to the trailing end leap evaluation experiment similarly as in Embodiment 5. A result of the evaluation experiment is shown in FIG. 16. Similarly as in Embodiment 5, compared with the high heat-conductive porous pressing roller in Comparison Example, the trailing end leap was suppressed.

Embodiment 7

The core metal 4*a* which is the base material may also has a hollow shape. FIG. 15 shows a pressing roller 4 in which the core metal 4*a* of the pressing roller 4 of FIG. 13 (Embodiment 5) is changed to a hollow core metal. Even in the case of the hollow core metal, similarly as in Embodiments 5 and 6, by making the thickness of the elastic layer 4*b* thicker at end portion positions than at the center position, the expansion of the pressing roller 4 at the end portions can be suppressed, so that the trailing end leap can be suppressed. A result of a comparison experiment with the conventional example was shown in FIG. 16.

In the above, as described in Embodiments 5-7, it is possible to provide the pressing roller which is capable of suppressing the non-sheet-passing portion temperature rise and which provides a short rise time and a reduced degree of the trailing end leap.

Other Embodiments (1) In Embodiments 1-7 described above, an example in which the pressing roller 4 which is the rotatable member is used as the fixing member was described, but the present invention is not limited thereto. For example, the fixing member 4 may also be in the form of an endless pressing belt which is the rotatable member. Specifically, as the base material (based layer) 4*a*, the endless (belt-shaped) member of a thin heat-resistant resin such as polyimide, polyamideimide or polyether ether ketone (PEEK) or a thin metal material such as stainless steel (SUS) or nickel (Ni) is used. In the belt form, on this base material, the elastic layer 4*b* having the above-described constitution is formed.

Further, as the fixing member, a member having a constitution in which the member is disposed in a side where the member contacts the toner image formed on the recording material (i.e., corresponds to the fixing film 3 described above) may also be used.

Figure 17:
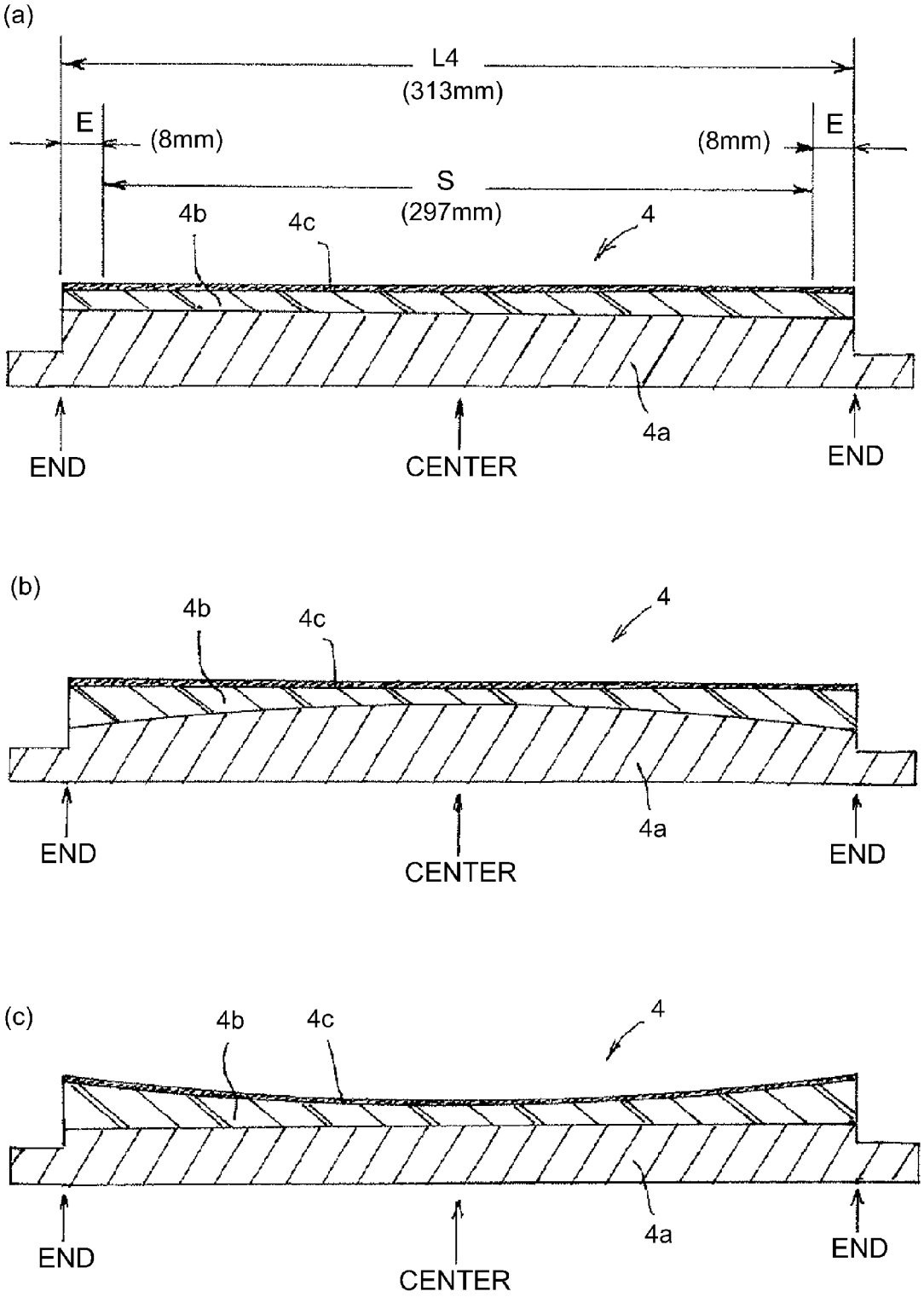
In FIG. 17, (a)-(c) are schematic structural views each showing a nip-forming member of a non-rotation type.

(2) The form of the fixing member 4 is not limited to the form of the rotatable member described above. The form may also be changed to the form of the heating member 3 to be rotationally driven or the form of a non-rotatable member such as elongated pad-like members, as shown in (a), (b) and (c) of FIG. 17, each having a smaller surface friction coefficient than that of the recording material P.

The recording material P introduced into the nip N is gradually nip-fed through the nip N by a rotational feeding force of the heating member 3 while sliding, in a back surface side (non-image forming surface side), on the surface of the nip-forming member 4 which is in the form of the non-rotatable member and which is small in friction coefficient.

(3) The heating type is not limited to the type using the ceramic heater but may also be a heat radiation type using a halogen lamp or the like, an electromagnetic induction heating type, another heat radiation type or the like. The heating type is also not limited to an internal heating type but may also be an outer heating type.

(4) The toner image forming principle and process on the recording material P are not limited to an electrophotographic process. An electrophotographic process of a direct type using photosensitive paper as the recording material may also be used. An electrostatic recording process of a transfer type using a dielectric member as the image bearing member or of a direct type, and a magnetic recording process of an intermediary transfer type using a magnetic material or of a direct type, and the like process may be used.

(5) The image heating apparatus may also embrace, in addition to the fixing device for fixing the unfixed toner image as the fixed image as in Embodiments, an image quality modifying device for improving glossiness or the like by re-heating and pressing the toner image temporarily fixed or once heat-fixed on the recording material.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-145828 filed on Jul. 16, 2014, which is hereby incorporated by reference herein in its entirety.

What is claimed is:

1. A fixing member used for fixing a toner image on a recording material, comprising:

a base layer; and a porous elastic layer provided on said base layer and configured to contain a needle-like filler, wherein said elastic layer has a thermal conductivity with respect to a longitudinal direction thereof in a first region where said fixing member is contactable to the recording material, the thermal conductivity is 6 times to 900 times a thermal conductivity with respect to a thickness direction in the first region, wherein said elastic layer has a thermal conductivity with respect to the thickness direction thereof in a second region outside the first region of said fixing member with respect to the longitudinal direction, and wherein the thermal conductivity with respect to the thickness direction in the second region is larger than the thermal conductivity with respect to the thickness direction in the first region.

2. The fixing member according to claim 1, wherein said elastic layer has a thickness larger in the first region than that in the second region.

3. The fixing member according to claim 1, wherein said elastic layer contains the needle-like filler in an amount of 5-40 volume %.

4. The fixing member according to claim 1, wherein the needle-like filler has a thermal conductivity of 500 W/(m·K) or more.

5. The fixing member according to claim 4, wherein the needle-like filler is 5-11 μm in length in a short direction and 100-1000 μm in length with respect to a longitudinal direction.

6. The fixing member according to claim 1, wherein the needle-like filler contains carbon fibers.

7. The fixing member according to claim 1, wherein said elastic layer has a porosity of 10-70 volume %.

8. The fixing member according to claim 1, further comprising a fluorine-containing resin layer provided on said elastic layer.

9. The fixing member according to claim 1, wherein said fixing member is contactable to an opposite surface of the recording material from a toner image-formed surface of the recording material.

10. A fixing member used for fixing a toner image on a recording material, comprising:

a base layer; and a porous elastic layer provided on said base layer and configured to contain a needle-like filler, wherein said elastic layer has a thickness in a first region where said fixing member is contactable to the recording material, and has a thickness in a second region outside the first region of said fixing member with respect to a longitudinal direction, and wherein the thickness in the second region is larger than the thickness in the first region.

11. The fixing member according to claim 10, wherein said elastic layer contains the needle-like filler in an amount of 5-40 volume %.

12. The fixing member according to claim 10, wherein the needle-like filler has a thermal conductivity of 500 W/(m·K) or more.

13. The fixing member according to claim 12, wherein the needle-like filler is 5-11 μm in length in a short direction and 100-1000 μm in length with respect to a longitudinal direction.

14. The fixing member according to claim 10, wherein the needle-like filler contains carbon fibers.

15. The fixing member according to claim 10, wherein said elastic layer has a porosity of 10-70 volume %.

16. The fixing member according to claim 10, further comprising a fluorine-containing resin layer provided on said elastic layer.

17. The fixing member according to claim 10, wherein said fixing member is contactable to an opposite surface of the recording material from a toner image-formed surface of the recording material.

* * * * *